US009818373B2

(12) United States Patent
Ohta et al.

(10) Patent No.: US 9,818,373 B2
(45) Date of Patent: Nov. 14, 2017

(54) DATA PROCESSING DEVICE FOR DISPLAY DEVICE, DISPLAY DEVICE EQUIPPED WITH SAME AND DATA PROCESSING METHOD FOR DISPLAY DEVICE

(71) Applicant: Sharp Kabushiki Kaisha, Osaka (JP)

(72) Inventors: Yoshifumi Ohta, Osaka (JP); Kengo Takahama, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 163 days.

(21) Appl. No.: 14/437,187

(22) PCT Filed: Oct. 24, 2013

(86) PCT No.: PCT/JP2013/078806
§ 371 (c)(1),
(2) Date: Apr. 20, 2015

(87) PCT Pub. No.: WO2014/069324
PCT Pub. Date: May 8, 2014

(65) Prior Publication Data

US 2015/0279324 A1 Oct. 1, 2015

(30) Foreign Application Priority Data

Oct. 31, 2012 (JP) ..... 2012-239906

(51) Int. Cl.
*G09G 3/36* (2006.01)
*G09G 5/10* (2006.01)
(Continued)

(52) U.S. Cl.
CPC ..... *G09G 5/10* (2013.01); *G09G 3/3233* (2013.01); *G09G 3/3283* (2013.01);
(Continued)

(58) Field of Classification Search
CPC .. G09G 3/12; G09G 3/14; G09G 3/30–3/3291
See application file for complete search history.

(56) References Cited

U.S. PATENT DOCUMENTS 6,356,666 B1 3/2002 Atsumi et al.
2003/0063053 A1 4/2003 Yamazaki et al.
(Continued)

FOREIGN PATENT DOCUMENTS

JP H06303596 A 10/1994
JP 2003177713 A 6/2003
(Continued)

OTHER PUBLICATIONS

K. Furukawa, et al., "Development of the All-Phosphorescent OLED Product for Lighting Applications", Konica Minolta Technology Report, vol. 9, 2012, English Abstract and figure descriptions, 6 pages.
(Continued)

*Primary Examiner* — Sanghyuk Park
(74) *Attorney, Agent, or Firm* — Morrison & Foerster LLP

(57) ABSTRACT

A unit equivalent value acquiring unit acquires a normal-temperature unit equivalent use time Δtn by using a temperature sensor, first to third LUTs, and a first multiplying unit. An integration unit acquires an equivalent cumulative use time to by integrating the normal-temperature unit equivalent use time Δtn. A maximum value detecting unit detects a maximum equivalent cumulative use time tnmax. A dividing unit acquires a correction coefficient Kcmp by dividing total degradation E(tnmax,Tn) acquired by a fourth LUT by total degradation E(tn,Tn) acquired by a fifth LUT. Accordingly, there is provided a data processing device for a display device capable of preventing burn-in while sup-
(Continued)

pressing time degradation of an electro-optical element and increase in the number of wires.

7 Claims, 13 Drawing Sheets

(51) Int. Cl.
*G09G 3/3233* (2016.01)
*G09G 3/3283* (2016.01)

(52) U.S. Cl.
CPC ..... *G09G 2300/0819* (2013.01); *G09G 2320/045* (2013.01); *G09G 2320/046* (2013.01)

(56) References Cited

U.S. PATENT DOCUMENTS

| | | | | |
|---|---|---|---|---|
| 2004/0150594 | A1 | 8/2004 | Koyama et al. | |
| 2008/0088648 | A1 | 4/2008 | Nathan et al. | |
| 2011/0033125 | A1 | 2/2011 | Shiraishi | |
| 2011/0074762 | A1* | 3/2011 | Shirasaki | G09G 3/3225 345/211 |
| 2011/0141160 | A1 | 6/2011 | Nathan et al. | |
| 2011/0254871 | A1* | 10/2011 | Yoo | G09G 3/3233 345/690 |
| 2012/0044270 | A1* | 2/2012 | Arkhipov | G09G 3/32 345/690 |
| 2012/0154682 | A1 | 6/2012 | Yamashita et al. | |

FOREIGN PATENT DOCUMENTS

| | | | |
|---|---|---|---|
| JP | 2004070349 | A | 3/2004 |
| JP | 2006201628 | A | 8/2006 |
| JP | 2007287971 | A | 11/2007 |
| JP | 2011040834 | A | 2/2011 |
| JP | 2012128147 | A | 7/2012 |
| WO | WO-199907155 | A1 | 2/1999 |

OTHER PUBLICATIONS

PCT International Search Report for PCT/JP2013/078806, dated Dec. 10, 2013, 4 pages.

* cited by examiner

Kcmp

DATA PROCESSING DEVICE FOR DISPLAY DEVICE, DISPLAY DEVICE EQUIPPED WITH SAME AND DATA PROCESSING METHOD FOR DISPLAY DEVICE

CROSS REFERENCE TO RELATED APPLICATIONS

This is a U.S. National Phase patent application of PCT/JP2013/078806, filed Oct. 24, 2013, which claims priority to Japanese Patent Application No. 2012-239906, filed Oct. 31, 2012, each of which is hereby incorporated by reference in the present disclosure in its entirety.

TECHNICAL FIELD

The present invention relates to a data processing device for a display device, and more particularly, relates to a data processing device for a display device using an electro-optical element such as an organic light-emitting diode (OLED) as a display element, a display device equipped with the data processing device, and a data processing method for the display device.

BACKGROUND ART

Conventionally, as for a display element provided in a display device, there exist an electro-optical element whose luminance is controlled by an applied voltage and an electro-optical element whose luminance is controlled by a flowing current. A liquid-crystal display element is a representative example of the electro-optical element whose luminance is controlled by an applied voltage. On the other hand, an OLED is a representative example of the electro-optical element whose luminance is controlled by a flowing current. The OLED is also called an organic electro-luminescence (EL) element. An organic EL display device using the OLED as a self light emission-type electro-optical element can achieve reduction in thickness, low power consumption, and high luminance as compared with the liquid crystal display device that generally requires a backlight, a color filter, and the like. Therefore, development of the organic EL display device has been progressed actively in recent years.

As driving systems of the organic EL display device, there are two kinds of driving systems, i.e., a passive matrix system (also called a simple matrix system), and an active matrix system. The organic EL display device employing the passive matrix system (hereinafter, referred to as a "passive matrix-type organic EL display device") has a simple structure, but realization of a large size and high precision is difficult. On the other hand, the organic EL display device employing the active matrix system (hereinafter, referred to as an "active matrix-type organic EL display device") can realize a large size and high precision easily as compared with the passive matrix-type organic EL display device.

The organic EL display device includes a plurality of pixel circuits arranged in a matrix form. Further, the pixel circuit of the active matrix-type organic EL display device typically includes an input transistor that selects a pixel, and a drive transistor that controls supply of a current to the OLED. In the following, the current that flows from the drive transistor to the OLED may be also referred to as a "drive current".

It is known that degradation of the OLED progresses as a light emission time of the OLED becomes long, and as a result, emission luminance becomes lower than that at the beginning. That is, when degradation of the OLED has progressed, luminance does not reach desired emission luminance even when a drive current having the same amount as that at the beginning is made to flow. In the following, the degradation that progresses with increase in the light emission time of the OLED is referred to as "time degradation". FIG. 16 is a diagram for describing an influence that time degradation of the OLED exterts on a display. As shown in FIG. 16, when attempting to make the OLED emit light in an area where white display is continued for a long time, light can be emitted only in lower emission luminance than desired emission luminance. This is because in the area where white display has been continued for a long time, time degradation of the OLED has progressed. On the other hand, in an area where black display has been continued for a long time, the time degradation of the OLED has not progressed. Therefore, the OLED can be made to emit light in the desired emission luminance. As described above, in a certain pixel, when the time degradation of the OLED has progressed more than that in surrounding pixels, there occurs a phenomenon called "burn-in" in which a difference in luminance between the pixels is recognized visually.

In Patent Document 1, there is disclosed an organic EL display device that detects reduction in capacitance of an OLED from a pixel circuit, and applies a drive current larger than an original drive current to the OLED in which time degradation has progressed, based on a correlation between a degree of time degradation of the OLED and the reduction in the capacitance of the OLED, so that the organic EL display device compensates for reduction in luminance. In the organic EL display device disclosed in Patent Document 1, there is provided, in a data driver, a read block for reading a voltage and the like from a pixel circuit to detect the reduction in the capacitance of the OLED. The read block transmits the read voltage to a controller.

In Patent Document 2, there is disclosed an organic EL display device that estimates an OLED in which time degradation has progressed most, by continuously or periodically sampling a video signal supplied to a controller, and compensates for reduction in luminance by applying a drive current larger than an original drive current to the estimated OLED.

In Patent Document 3, there is disclosed an organic EL display device that accumulates, in a capacitor in a pixel circuit, a voltage between terminals of an OLED which increases with progress of time degradation of the OLED, and compensates for reduction in luminance by using the accumulated voltage between the terminals of the OLED.

PRIOR ART DOCUMENTS

Patent Documents

[Patent Document 1] U.S. Patent Application Publication No. 2008/0088648

[Patent Document 2] Japanese Laid-Open Patent Publication No. 2003-177713

[Patent Document 3] U.S. Patent Application Publication No. 2011/0141160

[Patent Document 4] Japanese Laid-Open Patent Publication No. H06-303596

[Patent Document 5] PCT International Publication No. WO 1999/07155

[Patent Document 6] Japanese Laid-Open Patent Publication No. 2011-40834

Non-Patent Document

[Non-Patent Document 1] K. Furukawa, et al., "Development of the All-Phosphorescent OLED Product for Lighting Applications", KONICA MINOLTA TECHNOLOGY REPORT VOL. 9, 2012

SUMMARY OF THE INVENTION

Problems to be Solved by the Invention

Time degradation of the OLED progresses faster when a drive current is large. More specifically, when the OLED is made to emit light for the same length of time, a degree of time degradation of the OLED is proportional to a square of a current (that is, energy of the current). According to the organic EL display devices disclosed in above Patent Documents 1 to 3, reduction in luminance is compensated for by increasing a drive current that is applied to the OLED in accordance with the degree of time degradation of the OLED. Therefore, even when burn-in can be prevented, time degradation of the OLED is accelerated as a result. According to the organic EL display device disclosed in above Patent Document 1, the device requires a large number of wires for connecting the read block to the pixel circuit, and a large number of wires for transmitting to the controller a voltage read by the read block.

Therefore, an object of the present invention is to provide a data processing device for a display device, a display device equipped with the data processing device, and a data processing method for the display device, capable of preventing burn-in while suppressing time degradation of an electro-optical element as an OLED, for example, and suppressing increase in the number of wires.

Means for Solving the Problems

According to a first aspect of the present invention, there is provided a data processing device for a display device including a plurality of pixel circuits each having an electro-optical element whose luminance is controlled by a current, the data processing device including: an equivalent cumulative value acquiring unit that acquires, for each pixel circuit, an equivalent cumulative value reflecting a cumulative value of energy of a current which flows through at least the electro-optical element, based on gradation data corresponding to the luminance of the electro-optical element; a correction coefficient acquiring unit that acquires, for each pixel circuit based on the equivalent cumulative value of the pixel circuit, a correction coefficient which is approximately equal to or smaller than one when taking, as a reference, a maximum equivalent cumulative value among the equivalent cumulative values of the plurality of pixel circuits; and a correcting unit that outputs, as corrected gradation data, a value obtained by multiplying the correction coefficient by the gradation data.

According to a second aspect of the present invention, in the first aspect of the present invention, the equivalent cumulative value further reflects a degradation coefficient indicating time degradation of the electro-optical element according to a temperature of a surrounding of the display device, the equivalent cumulative value acquiring unit includes: a temperature acquiring unit that acquires the temperature of the surrounding of the display device, and a degradation coefficient acquiring unit that acquires the degradation coefficient based on the temperature of the surrounding of the display device, and the equivalent cumulative value acquiring unit acquires the equivalent cumulative value based on the gradation data and the degradation coefficient.

According to a third aspect of the present invention, in the second aspect of the present invention, the degradation coefficient indicates the time degradation of the electro-optical element according to the temperature of the surrounding of the display device based on a predetermined reference temperature.

According to a fourth aspect of the present invention, in the third aspect of the present invention, the equivalent cumulative value acquiring unit further includes: a unit equivalent value acquiring unit that acquires a unit equivalent value which reflects a current flowing through the electro-optical element in a predetermined period and the degradation coefficient in the predetermined period, based on the gradation data and the degradation coefficient acquired at a predetermined timing, and an integrating unit that obtains the equivalent cumulative value by integrating the unit equivalent value.

According to a fifth aspect of the present invention, in the fourth aspect of the present invention, the correction coefficient acquiring unit includes: a conversion unit that converts the maximum equivalent cumulative value and the equivalent cumulative value of each pixel circuit respectively to luminance of the electro-optical element at the reference temperature, and a dividing unit that obtains the correction coefficient by dividing the maximum equivalent cumulative value converted to the luminance by the equivalent cumulative value of each pixel circuit converted to the luminance.

According to a sixth aspect of the present invention, in the first aspect of the present invention, the correction coefficient acquiring unit acquires for each pixel circuit, as the correction coefficient, a value that is one when the equivalent cumulative value of the pixel circuit is the maximum equivalent cumulative value and that is a value smaller than one when the equivalent cumulative value of the pixel circuit is other than the maximum equivalent cumulative value, based on the maximum equivalent cumulative value and the equivalent cumulative value of the pixel circuit.

According to a seventh aspect of the present invention, in the first aspect of the present invention, the equivalent cumulative value acquiring unit, the correction coefficient acquiring unit, and the correcting unit are realized as one chip set.

According to an eighth aspect of the present invention, there is provided an active matrix-type display device including: the data processing device according to any one of claims 1 to 7; a plurality of data lines; a plurality of scanning lines; the plurality of pixel circuits arranged corresponding to the plurality of data lines and the plurality of scanning lines, each of the pixel circuits having the electro-optical element whose luminance is controlled by a current; a data drive unit that drives the plurality of data lines; a scanning drive unit that drives the plurality of scanning lines; and a display control unit that controls the data drive unit and the scanning drive unit, and receives the corrected gradation data from the data processing device and transmits, to the data drive unit, drive gradation data obtained based on the corrected gradation data.

According to a ninth aspect of the present invention, in the eighth aspect of the present invention, the pixel circuit further includes: an input transistor having a control terminal connected to the scanning line, and which is in an on state when the scanning line is selected; a drive capacitive element to which a data voltage based on the drive gradation data is given via the data line and the input transistor; and a drive transistor that controls current to be supplied to the electro-optical element, in accordance with a voltage held by the drive capacitive element.

According to a tenth aspect of the present invention, in the ninth aspect of the present invention, the input transistor is capable of outputting, to the data line, the current flowing through the drive transistor, when the input transistor is in the on state.

According to an eleventh aspect of the present invention, in the tenth aspect of the present invention, the scanning drive unit alternately repeats a first period for writing the data voltage to the pixel circuit by sequentially selecting the plurality of scanning lines and a second period for outputting the current flowing through the drive transistor, from the pixel circuit to the data line via the input transistor, by sequentially selecting a predetermined number of scanning lines out of the plurality of scanning lines, and shifts, in each of the second period, the predetermined number of scanning lines to be selected, the data drive unit includes: a current measurement unit that, in the second period, acquires for each of the data lines, first measurement data by measuring a current flowing through the electro-optical element in accordance with a data voltage based on drive gradation data corresponding to a relatively low first gradation out of a plurality of gradations, and acquires second measurement data by measuring a current flowing through the electro-optical element in accordance with a data voltage based on drive gradation data corresponding to a relatively high second gradation out of the plurality of gradations, and a data voltage supplying unit that supplies the data voltage to the data line in the first period and the second period, and the display control unit acquires the drive gradation data, by correcting the corrected gradation data based on the first measurement data and the second measurement data acquired by the current measurement unit.

According to a twelfth aspect of the present invention, in the eleventh aspect of the present invention, the display device further includes: a storage unit that stores correction data used for correcting the corrected gradation data, wherein the current measurement unit transmits the first measurement data and the second measurement data to the display control unit in the second period, in the second period, the display control unit transmits, to the data drive unit, drive gradation data indicating respectively the first gradation and the second gradation, receives the first measurement data and the second measurement data from the current measurement unit, and updates the correction data based on a result of comparing ideal characteristic data indicating an ideal characteristic of the drive transistor corresponding respectively to the first gradation and the second gradation, with the received first measurement data and the received second measurement data, and in the first period and the second period, the display control unit reads the correction data from the storage unit, and corrects the corrected gradation data based on the correction data.

According to a thirteenth aspect of the present invention, in the twelfth aspect of the present invention, the correction data includes first correction data for threshold voltage compensation of the drive transistor, and second correction data for gain compensation of the drive transistor, and the display control unit updates the first correction data based on a result of comparing the first measurement data with the ideal characteristic data, and updates the second correction data based on a result of comparing the second measurement data with the ideal characteristic data.

According to a fourteenth aspect of the present invention, in the eleventh aspect of the present invention, the display control unit and the data drive unit perform transmission and reception of the drive gradation data, the first measurement data, and the second measurement data by using a bidirectional communication bus.

According to a fifteenth aspect of the present invention, in the tenth aspect of the present invention, the display control unit acquires, based on the corrected gradation data, correction data for at least one of threshold voltage compensation of the drive transistor and gain compensation of the drive transistor according to a current which is assumed to flow through the electro-optical element, and acquires the drive gradation data by correcting the corrected gradation data based on the correction data.

According to a sixteenth aspect of the present invention, there is provided a data processing method for a display device including a plurality of pixel circuits each having an electro-optical element whose luminance is controlled by a current, the data processing method including: an equivalent cumulative value acquiring step of acquiring, for each pixel circuit, an equivalent cumulative value reflecting a cumulative value of energy of a current which flows through at least the electro-optical element, based on gradation data corresponding to the luminance of the electro-optical element; a correction coefficient acquiring step of acquiring, for each pixel circuit based on the equivalent cumulative value of the pixel circuit, acquiring a correction coefficient which is approximately equal to or smaller than one when taking, as a reference, a maximum equivalent cumulative value among the equivalent cumulative values of the plurality of pixel circuits; and a correcting step of outputting, as corrected gradation data, a value obtained by multiplying the correction coefficient by the gradation data.

Effects of the Invention

According to the first aspect of the present invention, for each pixel circuit based on the equivalent cumulative value of the pixel circuit, a correction coefficient that is approximately equal to or smaller than one is obtained by taking, as a reference, the maximum equivalent cumulative value among the equivalent cumulative values of the plurality of pixel circuits. The equivalent cumulative value of each pixel circuit reflects at least the cumulative value of energy of the current flowing through the electro-optical element (the drive current) included in the pixel circuit. Therefore, the equivalent cumulative value indicates the time degradation of the electro-optical element. Therefore, by using, as corrected gradation data, a product of the correction coefficient obtained as described above and the gradation data, the gradation data is corrected such that gradation of other pixel circuit is lowered, taking as a reference, a pixel circuit having an electro-optical element in which time degradation has progressed most (hereinafter, also referred to as a "pixel circuit in which time degradation has progressed most"). Therefore, the drive current is smaller than an original drive current in other pixel circuit, taking as a reference, a pixel circuit in which time degradation has progressed most. Accordingly, burn-in can be prevented by performing the luminance compensation, while suppressing time degradation of the electro-optical element. Further, since it is not necessary to read various parameters (a voltage applied to both ends of the electro-optical element, a drive current, and the like) from the pixel circuit in order to correct the gradation data in the data processing device, increase in the number of wires can be suppressed.

According to the second aspect of the present invention, a degradation coefficient indicating time degradation of the electro-optical element in accordance with the temperature of the surrounding of the display device is further reflected in the equivalent cumulative value. Since the time degradation of the electro-optical element also changes by the temperature, accurate luminance compensation can be performed using the equivalent cumulative value that further reflects the degradation coefficient.

According to the third aspect of the present invention, a degradation coefficient is acquired taking the predetermined reference temperature as a reference. Therefore, when the temperature of the surrounding of the display device is acquired, the degradation coefficient can be determined based on a predetermined equation, for example. Accordingly, it is not necessary to hold in advance correlation data between the cumulative value of the energy of the current and the temperature. Therefore, it is possible to make the memory capacity required in the data processing device relatively small.

According to the fourth aspect of the present invention, by obtaining the equivalent cumulative value by integrating the unit equivalent value acquired at a predetermined timing, it is possible to obtain an effect similar to that in the third aspect of the present invention.

According to the fifth aspect of the present invention, more accurate luminance compensation can be performed by using the correction coefficient acquired by dividing the maximum equivalent cumulative value converted to luminance by the equivalent cumulative value of each pixel circuit converted to luminance.

According to the sixth aspect of the present invention, more accurate luminance compensation can be performed by using the correction coefficient that is one when the equivalent cumulative value of each pixel circuit is the maximum equivalent cumulative value and that is smaller than one when the equivalent cumulative value of each pixel circuit is other than the maximum equivalent cumulative value.

According to the seventh aspect of the present invention, since the equivalent cumulative value acquiring unit, the correction coefficient acquiring unit, and the correcting unit (that is, the data processing device) are realized as one chip set, space can be saved.

According to the eighth aspect of the present invention, by transmitting, to the data drive unit, the drive gradation data obtained based on the corrected gradation data received from the data processing device according to any of the first to seventh aspect of the present invention, it is possible to obtain in the display device an effect similar to that in any of the first to seventh aspects of the present invention. Further, by setting the data processing device and the display control circuit as separate parts, and by providing the above data processing device in the front stage of the conventional display control circuit, it is possible to obtain the above effect without changing the display control circuit to have a special specification.

According to the ninth aspect of the present invention, by using the pixel circuit including the input transistor, the drive capacitive element, and the drive transistor, it is possible to reliably obtain an effect similar to that in the eighth aspect of the present invention.

According to the tenth aspect of the present invention, since the drive current can be output to the data line, by measuring the drive current, for example, it is possible to perform various corrections based on a measurement result. Therefore, since the drive current close to a desired value can be applied in each pixel circuit, errors in the correction of the gradation data in the data processing device can be reduced. Further, since the data line is used for reading of the drive current from the pixel circuit, increase in the number of wires can be suppressed.

According to the eleventh aspect of the present invention, in the second period, a predetermined number of scanning lines are selected sequentially, and the drive current is measured for each data line. Therefore, the first measurement data and the second measurement data are acquired for each pixel circuit. Then, the corrected gradation data is corrected based on the acquired first measurement data and second measurement data (hereinafter, simply referred to as "measurement data" when the first measurement data and the second measurement data are not distinguished in the description of the effects of the invention). When a drive transistor is controlled in accordance with a data voltage based on the corrected gradation data corresponding to a relatively low first gradation, the control voltage of the drive transistor (gate-source voltage) is relatively small. Thus, a gap of the threshold voltage from the control voltage is reflected largely in the drive current. On the other hand, when a drive transistor is controlled in accordance with a data voltage based on the corrected gradation data corresponding to a relatively high second gradation, the control voltage of the drive transistor is relatively large. Thus, a gap of the threshold voltage from the control voltage is not reflected easily in the drive current, whereas a gap of the gain is reflected relatively largely in the drive current. Therefore, the first measurement data is the data in which the gap of the threshold voltage is reflected largely, and the second measurement data is data in which the gap of the gain is reflected largely. As described above, since the corrected gradation data is corrected based on both the first measurement data in which the gap of the threshold voltage is reflected largely and the second measurement data in which the gap of the gain is reflected largely, both threshold voltage compensation and the gain compensation of the drive transistor can be performed for each pixel circuit. In the second period, since it is not necessary to stop light emission of the electro-optical element in parts other than the pixel circuit which is to be a target for measuring the drive current, compensation can be performed while performing the display. Further, since the corrected gradation data is corrected based on the first measurement data and the second measurement data acquired in the second period, it is possible to compensate following the chronological change of the characteristic of the drive transistor. As described above, since the drive current (the drive current close to the desired value) in which threshold voltage compensation and the gain compensation of the drive transistor are performed flows through each pixel circuit, errors in the correction of the gradation data can be reduced reliably in the data processing device.

According to the twelfth aspect of the present invention, by providing a storage unit storing the correction data, the correction data is updated based on a result of comparing the ideal characteristic data with the measurement data. By updating the correction data in this way, compensation following the chronological change of the characteristic of the drive transistor can be performed reliably. Further, the storage unit is provided at the outside of the data drive unit, configuration of the data drive unit can be simplified. Further, by using the ideal characteristic data, updating of the correction data can be performed by a simple processing.

According to the thirteenth aspect of the present invention, by preparing the first correction data and the second correction data, and by updating the first correction data and the second correction data respectively by comparing the first measurement data and the second measurement data with the ideal characteristic data, it is possible to obtain an effect similar to that in the twelfth aspect of the present invention.

According to the fourteenth aspect of the present invention, since the bidirectional communication bus is used, it is not necessary to separately provide wires for transmitting data from the data drive unit to the display control unit. Therefore, it is possible to suppress increase in the number of wires.

According to the fifteenth aspect of the present invention, without measuring the drive current, the display control unit corrects the corrected gradation data for at least one of the threshold voltage compensation and the gain compensation of the drive transistor. Therefore, in a simple configuration, it is possible to obtain an effect similar to that in the tenth aspect of the present invention.

According to the sixteenth aspect of the present invention, by the data processing method for the display device, it is possible to obtain an effect similar to that in the first aspect of the present invention.

MODES FOR CARRYING OUT THE INVENTION

First to third embodiments of the present invention will be described with reference to the accompanying drawings. A transistor included in a pixel circuit in each embodiment is a field-effect transistor, and is typically, a thin film transistor (TFT). Examples of the transistor included in the pixel circuit include an oxide TFT in which a channel layer is formed by an oxide semiconductor, a low-temperature polysilicon TFT in which a channel layer is formed by low-temperature polysilicon, and an amorphous silicon TFT in which a channel layer is formed by amorphous silicon. An example of the oxide TFT includes, particularly, a TFT in which a channel layer is formed by InGaZnOx as an oxide semiconductor containing indium (In), gallium (Ga), zinc (Zn), and oxide (O) as main components (the TFT is hereinafter referred to as an "InGaZnOx-TFT"). The oxide TFT such as the InGaZnOx-TFT is particularly effective in the case of employing the oxide TFT as an n-channel type transistor included in the pixel circuit. However, the present invention does not exclude the use of a p-channel type oxide TFT. Further, as the oxide semiconductor other than InGaZnOx, a similar effect is also obtained in the case of forming a channel layer by an oxide semiconductor containing at least one of indium, gallium, zinc, copper (Cu), silicon (Si), tin (Sn), aluminum (Al), calcium (Ca), germanium (Ge), and lead (Pb), for example.

In the following, it is assumed that m and n are integers equal to or larger than 2. In the following, a "state where a constituent element A is connected to a constituent element B" not only includes a case where the constituent element A is physically directly connected to the constituent element B but also includes a case where the constituent element A is connected to the constituent element B via other constituent element(s). However, the other constituent elements are limited to those which are not against the concept of the present invention. Further, in the following, when it is not necessary to distinguish between gradation data, corrected gradation data, and drive gradation data, these data may be expressed simply as "gradation data".

1. First Embodiment

<1.1 Overall Configuration>

Figure 1:
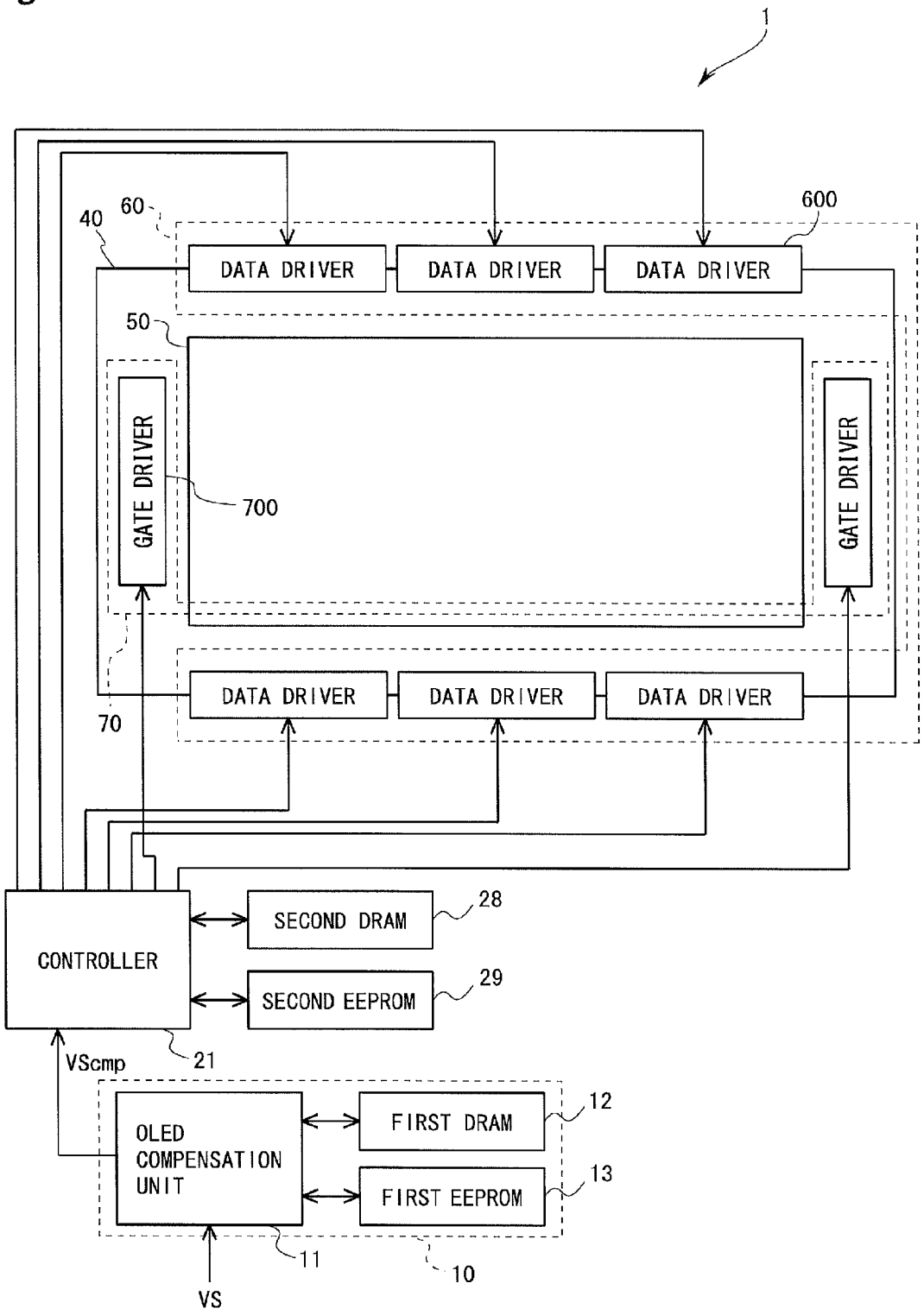
FIG. 1 is a block diagram showing a configuration of an organic EL display device according to a first embodiment of the present invention.

FIG. 1 is a block diagram showing a configuration of an active matrix-type organic EL display device 1 according to a first embodiment of the present invention. The organic EL display device 1 includes a data processing device 10, a controller 21 as a display control unit, a second dynamic random access memory (DRAM) 28, a second electrically erasable programmable read-only memory (EEPROM) 29, a display panel 40, a data drive unit 60, and a scanning drive unit 70. On the display panel 40, there are arranged the data drive unit 60 and the scanning drive unit 70. One or both of the data drive unit 60 and the scanning drive unit 70 may be integrally formed with the display unit 50. The second DRAM 28 and the second EEPROM may be provided inside the controller 21. The data processing device 10 includes an OLED compensation unit 11, a first DRAM 12, and a first EEPROM 13, and is realized as one chip set.

Figure 2:
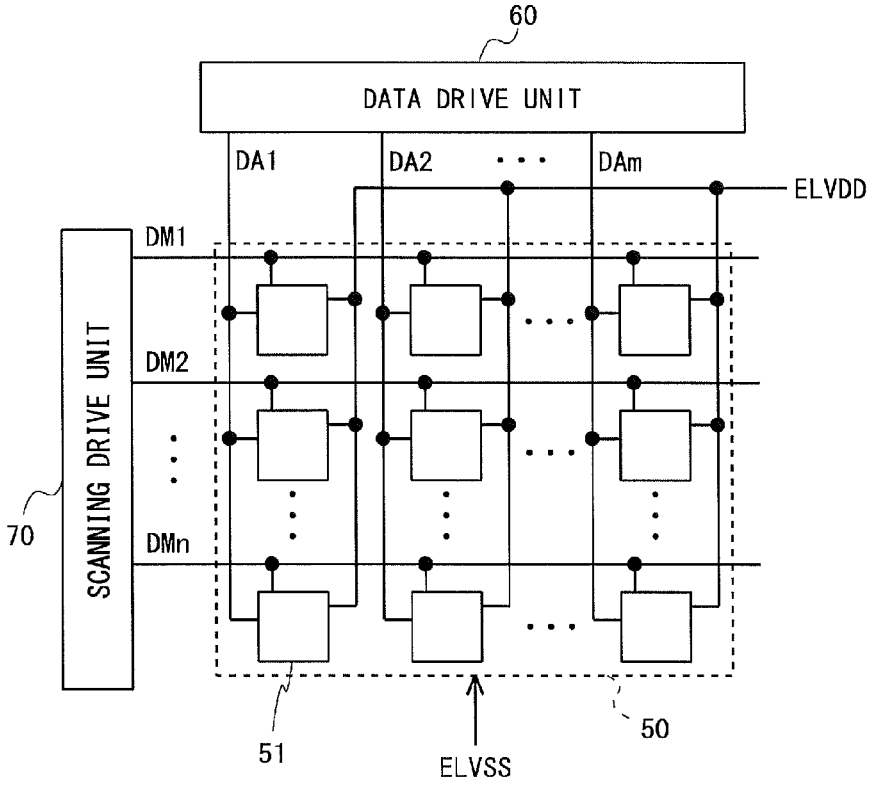
FIG. 2 is a block diagram for describing a configuration of a display unit shown in FIG. 1.

FIG. 2 is a block diagram for describing a configuration of the display unit 50 shown in FIG. 1. In the display unit 50, there are arranged m data lines DA1 to DAm and n scanning lines DM1 to DMn orthogonal to the data lines DA1 to DAm. In the case where it is not necessary to distinguish between the m data lines DA1 to DAm, the data lines DA1 to DAm are simply represented by symbol DA, and in the case where it is not necessary to distinguish between the n scanning lines DM1 to DMn, the scanning lines DM1 to DMn are simply represented by symbol DM. In the following, an extending direction of a data line DA is defined as a column direction, and an extending direction of a scanning line DM is defined as a row direction. In the display unit 50, there are further provided (m×n) pixel circuits 51 corresponding to the intersection between the m data lines DA1 to DAm and the n scanning lines DM1 to DMn. Each pixel circuit 51 constitutes any of a red sub-pixel (hereinafter, referred to as an "R sub-pixel"), a green sub-pixel (hereinafter, referred to as a "G sub-pixel"), and a blue sub-pixel (hereinafter, referred to as a "B sub-pixel"). The pixel circuits 51 arranged in the row direction sequentially constitute the R sub-pixel, the G sub-pixel, and the B sub-pixel from the leftmost end in FIG. 2, for example. Kinds of the sub-pixels are not limited to red, green, and blue, and may be cyan, magenta, and yellow.

In the display unit 50, there are arranged a power supply line for supplying a high-level power supply voltage ELVDD (the line is hereinafter referred to as a "high-level power supply line", and is represented by the same symbol ELVDD as the high-level power supply voltage), and a power supply line for supplying a low-level power supply voltage ELVSS (the line is not shown, is hereinafter referred to as a "low-level power supply line", and is represented by the same symbol ELVSS as the low-level power supply voltage). The high-level power supply voltage ELVDD and the low-level power supply voltage ELVSS have fixed values. The low-level power supply voltage ELVSS is a ground voltage, for example.

Figure 11:
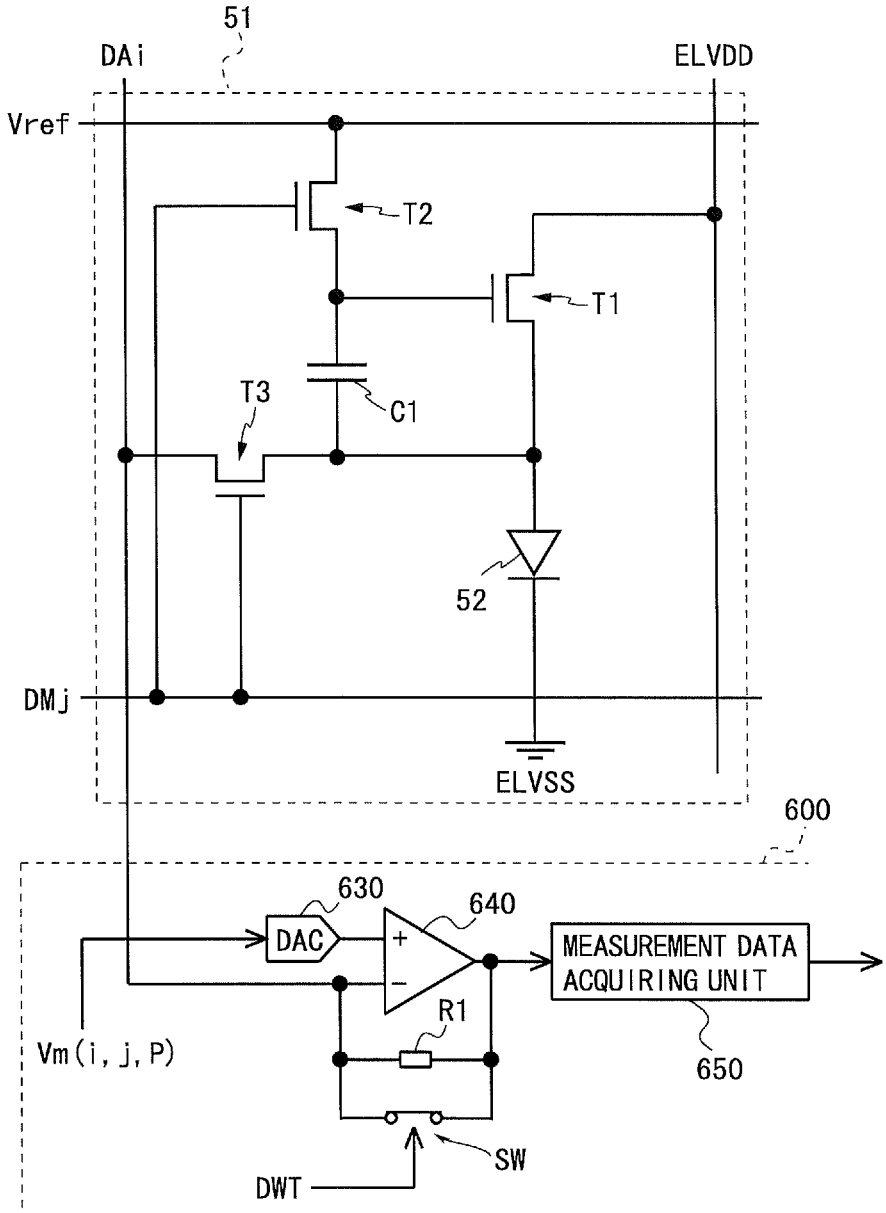
FIG. 11 is a circuit diagram showing a pixel circuit and a part of a constituent element at a data driver side corresponding to the pixel circuit according to the above second embodiment.

The OLED compensation unit 11 shown in FIG. 11 receives a video signal VS from the outside, and transmits, to the controller 21, a corrected video signal VScmp obtained by correcting the video signal VS. The video signal VS includes gradation data P of each pixel (the gradation may be also represented by the same symbol P). The corrected video signal VScmp includes corrected gradation data Pcmp of each pixel (the corrected gradation may be also represented by the same symbol Pcmp). The OLED compensation unit 11 performs various operations by using the first DRAM 12. The first EEPROM 13 is used to store, at a power-off time, various data used by the OLED compensation unit 11 and the first DRAM 12, and to restore the various data at a power-on time. Details of the data processing device 10 will be described later.

The controller 21 controls the data drive unit 60 and the scanning drive unit 70, based on the corrected video signal VScmp (the corrected gradation data Pcmp) received from the OLED compensation unit 11, and a synchronization signal (not shown). More specifically, the controller 21 controls the data drive unit 60 and the scanning drive unit 70 by transmitting, to the data drive unit 60, the drive gradation data obtained based on various control signals and the corrected gradation data Pcmp, and by transmitting various control signals to the scanning drive unit 70. The controller 21 performs various operations by using the second DRAM. The second EEPROM 29 is used to store, at a power-off time, various data used by the controller 21 and the second DRAM 28, and to restore the various data at a power-on time.

The data drive unit 60 includes a plurality of data drivers 600. However, the data drive unit 60 may be configured by one data driver 600. In FIG. 1, six data drivers 600 are provided. Out of the six data drivers 600, three data drivers 600 are arranged at an upper end side of the display panel 40, and remaining three data drivers 600 are arranged at a lower end side of the display panel 40. This arrangement of the data drivers 600 is a mere example, and the present invention is not limited thereto. To each data driver 600, k (k=m/6, in the example of FIG. 1) data lines are connected. Each data driver 600 supplies data voltages based on the drive gradation data to the data lines DA, following the control signal received from the controller 21. In the following, a total operation of the data drive unit 60 is also described by representing one data driver 600, for the sake of convenience.

The scanning drive unit 70 includes a plurality of gate drivers 700. However, the scanning drive unit 70 may be configured by one gate driver 700. In FIG. 1, two gate drivers 700 are provided. Out of the two gate drivers 700, one is arranged at a left end side of the display panel 40, and the other is arranged at a right end side of the display panel 40. This arrangement of the gate drivers 700 is a mere example, and the present invention is not limited thereto. The scanning drive unit 70 selects the n scanning lines DM1 to DMn sequentially, following the control signal received from the controller 21.

<1.2 Pixel Circuit>

Figure 3:
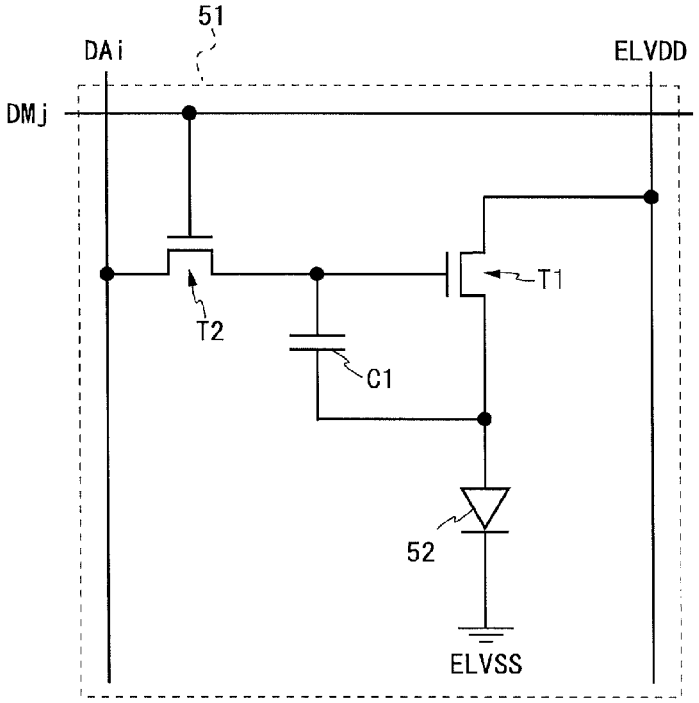
FIG. 3 is a circuit diagram showing an example of a pixel circuit shown in FIG. 2.

The pixel circuit 51 shown in FIG. 2 may have any configuration as long as the pixel circuit 51 includes: an OLED; an input transistor that has a gate terminal (control terminal) connected to a scanning line DM and that is in an on state when the scanning line DM is being selected; a drive capacitive element to which a data voltage based on drive gradation data is given via a data line DA and the input transistor; and a drive transistor that controls a current to be supplied to the OLED (drive current) in accordance with a voltage held in the drive capacitive element. FIG. 3 is a circuit diagram showing an example of the pixel circuit 51 shown in FIG. 2. The pixel circuit 51 shown in FIG. 3 is a pixel circuit 51*a* in a j-th row and an i-th column. As shown in FIG. 3, the pixel circuit 51 includes one OLED 52, two transistors T1 and T2, and one capacitor (drive capacitive element) C1. The transistor T1 is a drive transistor, and the transistor T2 is an input transistor. The transistors T1 and T2 are all of n-channel type, and are InGaZnOx-TFTs, for example.

The transistor T1 is connected in series to the OLED 52, has as a first conductive terminal a drain terminal connected to the high-level power supply line ELVDD, and has as a second conductive terminal a source terminal connected to an anode terminal of the OLED 52. The transistor T2 has a gate terminal connected to a scanning line DMj, and is provided between a data line DAi and a gate terminal of the transistor T1. The capacitor C1 is provided between the gate terminal and the source terminal of the transistor T1. A cathode terminal of the OLED 52 is connected to the low-level power supply line ELVSS.

In the following, it is assumed that when the potential of the scanning line DMj is in the "1" level, the scanning line DMj is in the selected state, and when the potential of the scanning line DMj is in the "0" level, the scanning line DMj is in the non-selected state. When the potential of the scanning line DMj becomes the "1" level, the transistor T2 is turned on, and a data voltage is written to the capacitor C1. In the following, the data voltage of the gradation P written to the pixel circuit 51 in the j-th row and the i-th column is represented by symbol Vm(i,j,P). The gradation data that is a basis of the data voltage Vm(i,j,P) is also represented by symbol Vm(i,j,P) for the sake of convenience. Thereafter, when the potential of the scanning line DMj has become the "0" level, the transistor T2 is turned off, and a gate-source voltage Vgs of the transistor T1 held in the capacitor C1 is settled. It is assumed here that Vgs=Vm(i,j,P). Since the transistor T1 operates in a saturation region, a drive current Ioled is given by the following equation (1).

$$Ioled = (\beta/2)*(Vgs - Vt)^2 = (\beta/2)*(Vm(i, j, P) - Vt)^2 \quad (1)$$

Here, β and Vt indicate the gain and the threshold voltage of the transistor T1, respectively. The gain β is given by the following equation (2).

$$\beta=\mu*(W/L)*Cox \quad (2)$$

Here, μ, W, L, and Cox indicate mobility, a gate width, a gate length, and a gate insulation film capacitance per unit area of the transistor T1, respectively.

As described above, since the drive current Ioled according to the data voltage Vm(i,j,P) flows through the OLED 52, the OLED 52 emits light in the luminance according to the drive current Ioled (in other words, in the luminance according to the gradation P).

<1.3 Time Degradation of OLED>

When the gradation data of the pixel in the j-th row and the i-th column at time t is represented by Im(i,j,t), the drive current I(i,j,t) that flows through the OLED of the pixel in the j-th row and the i-th column at time t is given by the following equation (3).

$$I(i,j,t)=I_{255}*[Im(i,j,t)/255]^{2.2} \quad (3)$$

Here, $I_{255}$ indicates the drive current when Im(i,j,t)=255. It is assumed that the drive current I(i,j,t) has a value following the ideal characteristic of γ=2.2. Although the maximum gradation is assumed to be 255 here, the present invention is not limited thereto.

In general, it is known that the degree of time degradation of the OLED is proportional to the square of the drive current (that is, the energy of the drive current) (in other words, the lifetime of the OLED becomes short inversely proportional to the square of the drive current). Based on the above equation (3), the equivalent current indicating time degradation of the OLED is expressed by the following equation (4).

$$[I(i,j,t)/I_{255}]^2=\{[Im(i,j,t)/255]^{2.2}\}^2 \quad (4)$$

From the equation (4), the equivalent cumulative current Iequ(i,j) indicating time degradation of the OLED from time t0 to tn is given by the following equation (5).

$$Iequ(i,j)=\int_{t0}^{tn}\{[Im(i,j,t)/255]^{2.2}\}^2 dt \quad (5)$$

Figure 4:
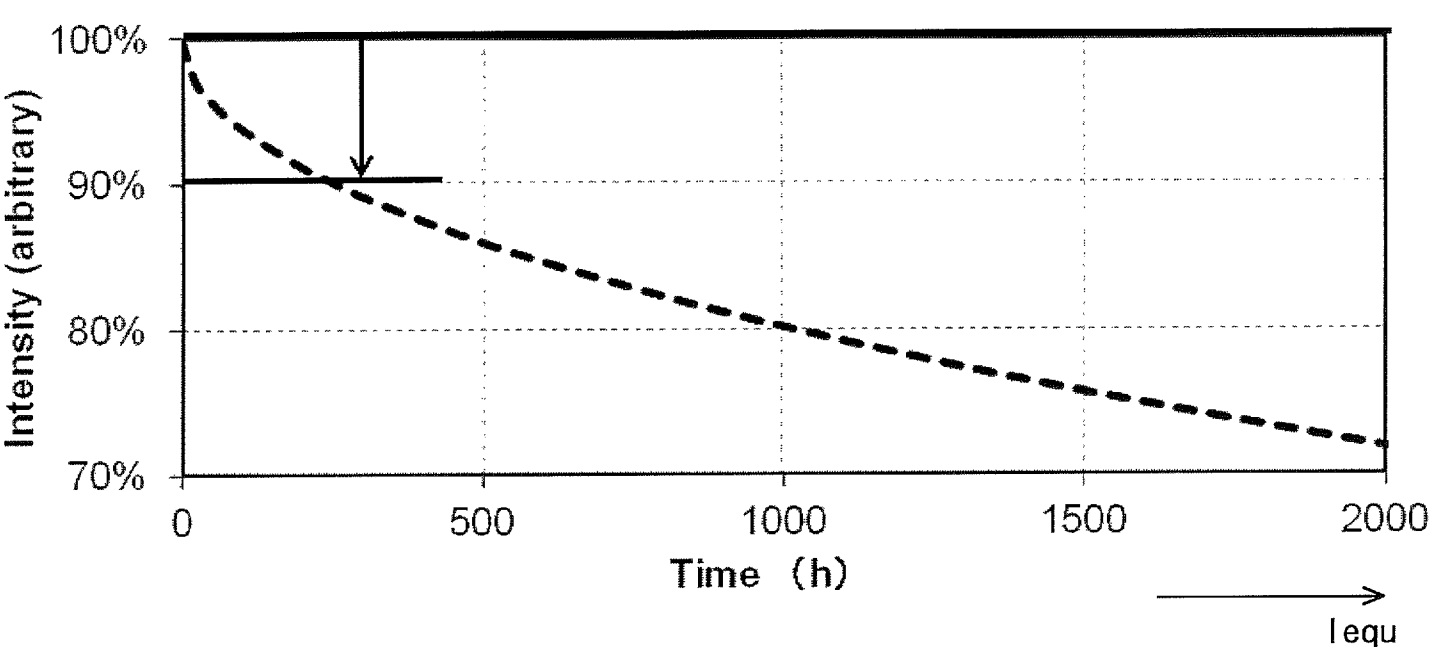
FIG. 4 is a diagram for describing a state where an OLED is degraded with elapse of time.

There is considered compensation for time degradation of the OLED by obtaining the correction coefficient Kcmp from the equivalent cumulative current Iequ(i,j) and correcting the gradation data P (refer to FIG. 4). It is known that time degradation of the OLED depends on a temperature of the surroundings. Therefore, at the time of compensating for time degradation of the OLED, it is desirable to consider the temperature of the surroundings of the organic EL display device (hereinafter, simply referred to as a "surrounding temperature"). A relationship between time degradation of the OLED and the surrounding temperature will be described below.

Figure 5:
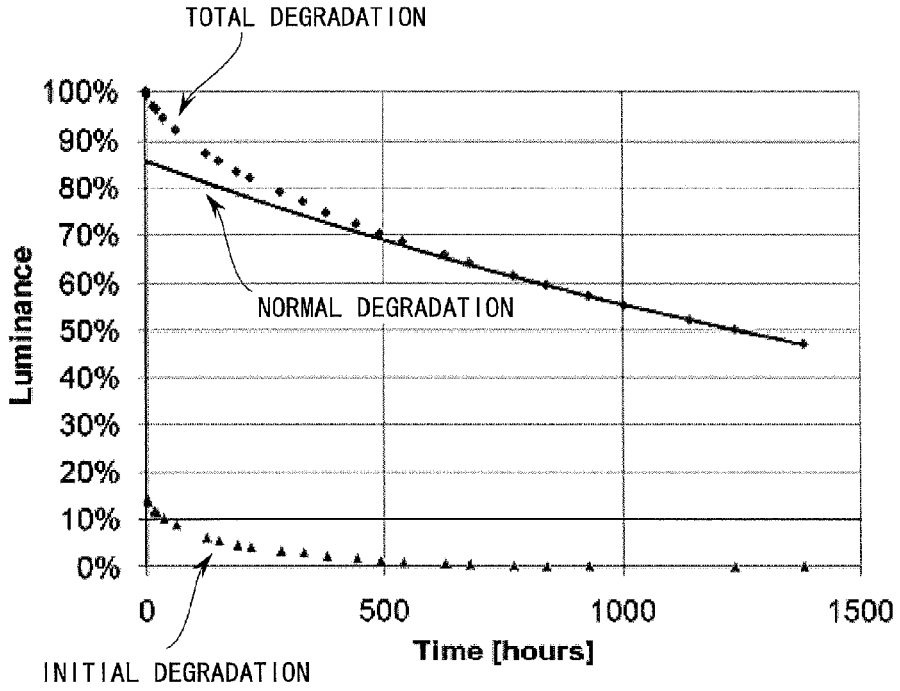
FIG. 5 is a diagram showing a graph of an equation (6).

According to Non-Patent Document 1, time degradation of the OLED is divided into initial degradation that progresses rapidly and normal degradation that progresses stably. In the following, time degradation of the OLED including initial degradation and normal degradation may be also referred to as "total degradation" for the sake of convenience (refer to FIG. 5). Actually, total degradation, initial degradation, and normal degradation mentioned here indicate luminance as described below. However, since such luminance becomes an index of time degradation, the luminance itself is expressed as "degradation". Total degradation of the OLED is given by the following equation (6).

$$L = \alpha_1 \cdot L_1 + \alpha_2 \cdot L_2 = \alpha_1 \cdot \exp\left(\frac{E_{ainitial}}{kT}\right) \cdot \exp\left(-\frac{t}{A_1}\right) + \left[1 - \alpha_1 \cdot \exp\left(\frac{E_{ainitial}}{kT}\right)\right] \cdot \exp\left[-\frac{t}{A_2 \cdot \exp\left(\frac{E_{anormal}}{kT}\right)}\right] \quad (6)$$

Here, L indicates total degradation, $\alpha_1$ and $\alpha_2$ indicate constants, t indicates time, $L_1$ indicates relative luminance of initial degradation standardized by an initial degradation component (a proportion of initial degradation occupied in total degradation), $L_2$ indicates relative luminance of normal degradation standardized by a normal degradation component (a proportion of normal degradation occupied in total degradation), k indicates a Boltzmann constant, T indicates an absolute temperature, $E_{ainitial}$ indicates energy of the initial degradation component, $E_{anormal}$ indicates energy of the normal degradation component, $A_1$ indicates time for the initial degradation component to reach 1/e times of the initial value, and $A_2$ indicates time for the normal degradation component to reach 1/e times of the initial value. Here, e≅2.718. The first term of the right side of the equation (6) indicates initial degradation, and the second term indicates normal degradation.

From the equation (6), a time constant Ta of initial degradation is given by the following equation (7).

$$Ta=A_1 \quad (7)$$

From the equation (6), a time constant Tb of normal degradation is given by the following equation (8).

$$Tb = A_2 \cdot \exp\left(-\frac{E_{anormal}}{kT}\right) \quad (8)$$

As shown in the equation (7), even when the temperature T changes, the time constant Ta of initial degradation does not change. On the other hand, as shown in the equation (8), when the temperature T changes, the time constant Tb of normal degradation changes. Specifically, when the temperature T becomes high, the time constant Tb becomes short, and when the temperature T becomes low, the time constant Tb becomes long. In this manner, when the temperature T changes, the progress of normal degradation changes, and as a result, total degradation L also changes. In the present embodiment, a time degradation model of the OLED considering a temperature change as shown above is employed. In the following, the total degradation L shown in the equation (6) is expressed as a function E(t,T) of the time t and the temperature T.

At the time of using the organic EL display device, the surrounding temperature may change as time passes. Therefore, for the sake of convenience of calculation processing, it is preferable that time degradation at each temperature is converted to time degradation at a certain reference temperature. Converting a use time of the OLED at each temperature to a use time of the OLED at a certain reference temperature is considered here. In the following, the reference temperature is expressed as a "normal temperature", a temperature higher than the normal temperature is expressed as a "high temperature", and a temperature lower than the normal temperature is expressed as a "low temperature". A temperature which is set as the normal temperature is not particularly limited.

Figure 6:
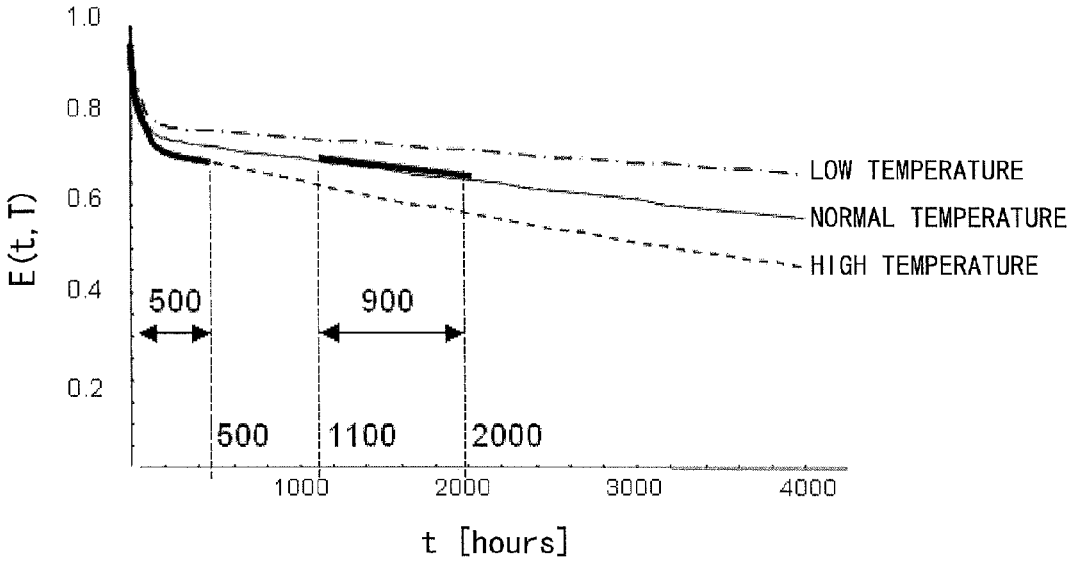
FIG. 6 is a diagram for describing conversion of a use time of the OLED.

FIG. 6 is a diagram for describing conversion of a use time of the OLED. In a degradation curve shown in FIG. 6, the use at the high temperature for 500 h (hours) corresponds to the use at the normal temperature for 1100 h. Therefore, when the OLED is used at the normal temperature for 900 h after being used at the high temperature for 500 h, a total use time converted to a use time based on the normal temperature corresponds to 2000 h. Conversion from the low temperature to the normal temperature can be performed similarly. By performing such conversion to the normal temperature, an equivalent use time at the normal temperature can be obtained.

Next, calculation of an equivalent use time at the normal temperature will be described. In the following, the normal temperature is represented by Tn, and the equivalent use time at the normal temperature Tn (hereinafter, referred to as a "normal-temperature equivalent use time") is represented by tn. A generalized temperature of the high temperature, the low temperature, and the normal temperature Tn (hereinafter, referred to as a "general temperature") is represented by Ts, and a use time at the general temperature Ts (hereinafter, referred to as a "general temperature use time") is represented by ts.

Figure 7:
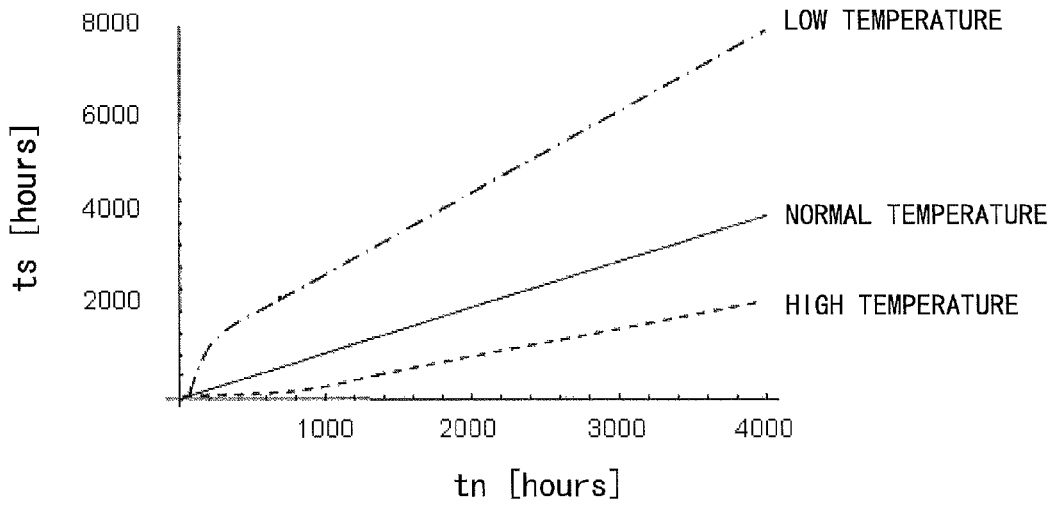
FIG. 7 is a diagram showing a relationship between an equivalent use time at a normal temperature and equivalent use times at a general temperature.

Total degradation at the general temperature Ts is represented by E(ts,Ts), and total degradation at the normal temperature Tn is represented by E(tn,Tn). Since the general temperature use time ts is converted to the normal-temperature equivalent use time tn (refer to FIG. 7), total degradation E(ts,Ts) at the general temperature Ts and total degradation E(tn,Tn) at the normal temperature Tn are in the relationship shown by the following equation (9).

$$E(ts,Ts)=E(tn,Tn) \tag{9}$$

Next, total degradation ΔE per unit use time Δts concerning the general temperature Ts (hereinafter, referred to as a "general-temperature unit use time") is given by the following equation (10).

$$\Delta E = \frac{\partial E(ts, Ts)}{\partial ts}\Delta ts \tag{10}$$

Total degradation ΔE per unit equivalent use time Δtn concerning the normal temperature Tn (hereinafter, referred to as a "normal-temperature unit equivalent use time") is given by the following equation (11).

$$\Delta E = \frac{\partial E(tn, Tn)}{\partial tn}\Delta tn \tag{11}$$

From the above equation (10) and the equation (11), the normal-temperature unit equivalent use time Δtn can be expressed by the following equation (12).

$$\Delta tn = \left[\frac{\partial E(ts, Ts)}{\partial ts} \Big/ \frac{\partial E(tn, Tn)}{\partial tn}\right]\Delta ts \tag{12}$$

The general temperature use time ts in the equation (12) can be represented by ts(tn,Ts) using the normal-temperature equivalent use time tn. That is, the equation (12) can be expressed by the following equation (13).

$$\Delta tn = \left[\frac{\partial E(ts, Ts)}{\partial ts}\Big|_{ts=ts(tn,Ts)} \Big/ \frac{\partial E(tn, Tn)}{\partial tn}\right]\Delta ts \tag{13}$$

Figure 8:
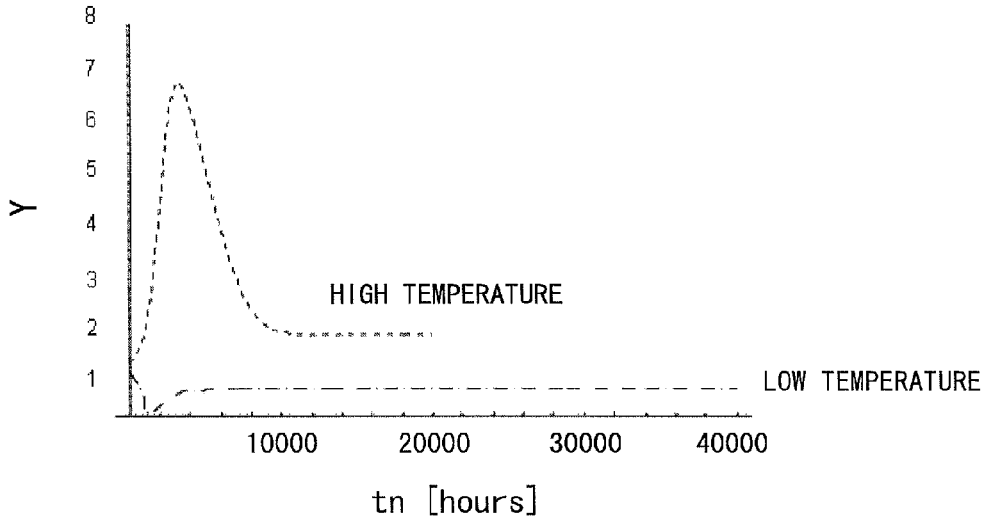
FIG. 8 is a diagram showing a graph of an equation (14).

It is possible to obtain ts(tn,Ts) by the above equation (9). Specifically, setting Tn=300 in the above equation (9) (an example of the normal temperature), the general temperature Ts is fixed, and the general temperature use time ts which corresponds to each normal-temperature equivalent use time tn is obtained. When the operation of obtaining the above-described general temperature use time ts is repeated with changing the general temperature Ts variously, ts(tn,Ts) can be obtained. When drawing a graph of the right side coefficient in the equation (13) (represented by Y for the sake of convenience, as shown in the following equation (14)), the graph is shown in FIG. 8.

$$Y = \frac{\partial E(ts, Ts)}{\partial ts}\Big|_{ts=ts(tn,Ts)} \Big/ \frac{\partial E(tn, Tn)}{\partial tn} \tag{14}$$

The coefficient Y shown in the equation (14) corresponds to a degradation coefficient according to the surrounding temperature based on the normal temperature Tn.

As described above, the degree of time degradation of the OLED is proportional to the square of the drive current. Therefore, when standard total degradation E(tn,Tn) at the normal temperature is total degradation at a current i0, when the drive current that flows through the OLED actually is ix, and when a time during which the drive current ix flows through the OLED actually is Δt, a general-temperature unit use time Δts as a fine change time of the general-temperature use time is in which the drive current ix is reflected is given by the following equation (15).

$$\Delta ts=(ix/i0)^2\Delta t \tag{15}$$

Based on the general-temperature unit use time Δts shown in the equation (15) and the above equation (13), the equivalent cumulative use time is obtained by the following equation (16), as the equivalent cumulative value in which the temperature change is reflected in the above-described equivalent cumulative current Iequ(i,j) (that is, the cumulative value of the energy of the drive current that flows through the OLED and the degradation coefficient Y are reflected in the equivalent cumulative value).

$$\begin{aligned}\sum \Delta tn &= \sum\left\{\left[\frac{\partial E(ts, Ts)}{\partial ts}\Big|_{ts=ts(tn,Ts)} \Big/ \frac{\partial E(tn, Tn)}{\partial tn}\right]\left[\frac{ix}{i0}\right]^2\Delta t\right\} \\ &= \sum\left\{\left[\frac{\partial E(ts, Ts)}{\partial ts}\Big|_{ts=ts(tn,Ts)} \Big/ \frac{\partial E(tn, Tn)}{\partial tn}\right]\left[\frac{Im(i, j, t)}{255}\right]^{4.4}\Delta t\right\}\end{aligned} \tag{16}$$

Since the equivalent cumulative use time shown in the equation (16) is equal to the normal temperature use time tn, the equivalent cumulative use time is also represented by symbol tn.

In the present embodiment, time degradation of the OLED 52 is compensated for, by obtaining the correction coefficient Kcmp from the equivalent cumulative use time tn obtained as described above, and correcting the gradation data P. In the following, a detailed configuration of the data processing device 10 for performing the compensation will be described.

<1.4 Data Processing Device>

Figure 9:
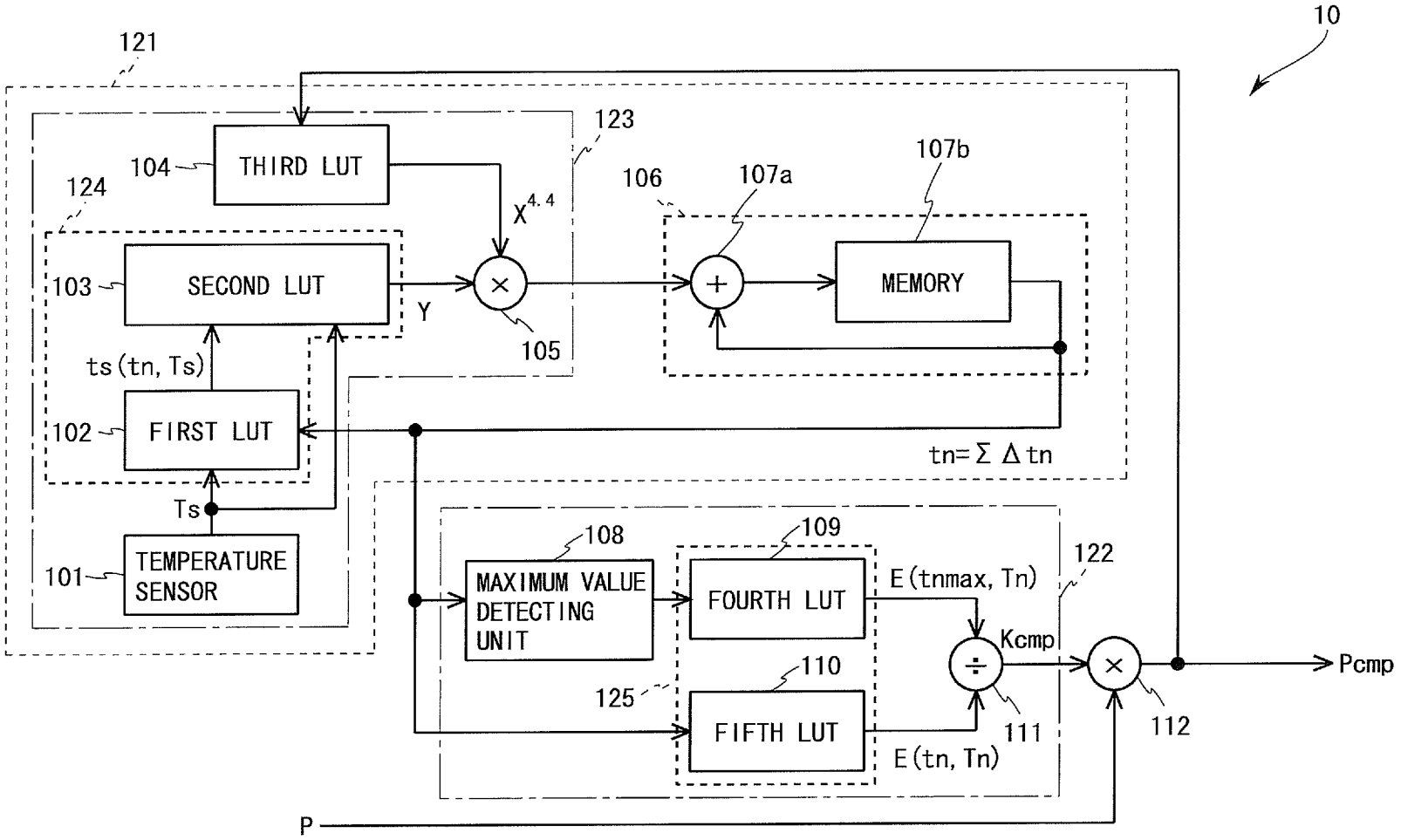
FIG. 9 is a block diagram showing a functional configuration of a data processing device shown in FIG. 1.

FIG. 9 is a block diagram showing a functional configuration of the data processing device 10 shown in FIG. 1. The data processing device 10 includes a temperature sensor 101, a first look up table (LUT) 102, a second LUT 103, a third LUT 104, a first multiplying unit 105, an integration unit 106, a maximum value detecting unit 108, a fourth LUT 109, a fifth LUT 110, a dividing unit 111, and a second multiplying unit 112. In the present embodiment, an equivalent cumulative value acquiring unit 121 is realized by the temperature sensor 101, the first LUT 102, the second LUT 103, the third LUT 104, the first multiplying unit 105, and the integration unit 106. Further, a correction coefficient acquiring unit 122 is realized by the maximum value detecting unit 108, the fourth LUT 109, the fifth LUT 110, and the dividing unit 111. Further, a correcting unit is realized by the second multiplying unit 112. A unit equivalent value acquiring unit 123 is realized by the temperature sensor 101, the first LUT 102, the second LUT 103, the third LUT 104, and the first multiplying unit 105. A degradation coefficient acquiring unit 124 is realized by the first LUT 102 and the second LUT 103. A conversion unit 125 is realized by the fourth LUT 109 and the fifth LUT 110. A temperature acquiring unit is realized by the temperature sensor 101.

The temperature sensor 101 acquires the surrounding temperature (the general temperature Ts) at a predetermined timing, and gives the surrounding temperature to the first LUT 102 and the second LUT 103. The first LUT 102 acquires the above-described general temperature use time ts(tn,Ts) based on the general temperature Ts and the equivalent cumulative use time tn, and gives the general temperature use time ts(tn,Ts) to the second LUT 103. The second LUT 103 acquires the degradation coefficient Y based on the general temperature Ts and the general temperature use time ts(tn,Ts), and gives the degradation coefficient Y to the first multiplying unit 105. The third LUT 104 acquires $X^{4.4}$ based on the corrected gradation data Pcmp, and gives $X^{4.4}$ to the first multiplying unit 105. Here, X=Im(i,j,t)/255. In place of the corrected gradation data Pcmp, the gradation data P may be given to the third LUT 104. However, giving the corrected gradation data Pcmp to the third LUT 104 can increase accuracy more. Since the corrected gradation data Pcmp is acquired based on the gradation data P, acquiring $X^{4.4}$ based on the corrected gradation data Pcmp can be said to acquire $X^{4.4}$ based on the gradation data P. The first multiplying unit 105 gives a product of the degradation coefficient Y and $X^{4.4}$ (corresponding to Δtn shown in the above equation (13)) to the integration unit 106. The product of the degradation coefficient Y and $X^{4.4}$ acquired in this way corresponds to the unit equivalent value that reflects the drive current which flows through the OLED 52 in the predetermined period and the degradation coefficient Y in the predetermined period, based on the corrected gradation data Pcmp and the degradation coefficient Y acquired at the predetermined timing. The "predetermined period" mentioned here corresponds to Δt, and it is desirable to determine the timing of acquiring the degradation coefficient Y (may also be referred to as the timing of acquiring the surrounding temperature) such that the change in the drive current in each predetermined period becomes small. Accordingly, calculation accuracy of the degradation coefficient Y can be enhanced.

The integration unit 106 includes a first adding unit 107*a* and a memory 107*b*. The memory 107*b* is realized by a predetermined storage region of the first DRAM 12. By the first adding unit 107*a* and the memory 107*b*, the product of the degradation coefficient Y and $X^{4.4}$ given from the first multiplying unit 105 is integrated, so that the equivalent cumulative use time to shown in the above equation (16) is acquired for each pixel circuit 51. In the above equation (16), Δt indicates the time increment of the integration. The equivalent cumulative use time tn corresponds to the equivalent cumulative value. The integration unit 106 gives the acquired equivalent cumulative use time tn to the maximum value detecting unit 108 and the fifth LUT 110.

The maximum value detecting unit 108 detects a maximum equivalent cumulative use time tn in the equivalent cumulative use time tn of the total pixels (the detected time is hereinafter referred to as a "maximum equivalent cumulative use time tnmax"). The maximum value detecting unit 108 gives the maximum equivalent cumulative use time tnmax to the fourth LUT 109. The fourth LUT 109 acquires total degradation E(tnmax,Tn) at the normal temperature Tn based on the maximum equivalent cumulative use time tnmax, and gives the total degradation E(tnmax,Tn) to the dividing unit 111. The fifth LUT 110 acquires total degradation E(tn,Tn) at the normal temperature Tn based on the equivalent cumulative use time tn (in each pixel), and gives the total degradation E(tn,Tn) to the dividing unit 111. The dividing unit 111 acquires the correction coefficient Kcmp given by the following equation (17) based on the total degradation E(tnmax,Tn) and the total degradation E(tn,Tn), and gives the correction coefficient Kcmp to the second multiplying unit 112.

$$Kcmp=E(tn\max,Tn)/E(tn,Tn) \tag{17}$$

Because E(tnmax,Tn)≤E(tn,Tn), the correction coefficient Kcmp is equal to or smaller than one.

The second multiplying unit 112 acquires the corrected gradation data Pcmp given by the following equation (18), based on the gradation data P and the correction coefficient Kcmp.

$$Pcmp=P*Kcmp \tag{18}$$

The corrected gradation data Pcmp of the total pixels is transmitted to the controller 21 as a corrected video signal.

<1.5 Effects>

According to the present embodiment, for each pixel circuit 51, by dividing the total degradation E(tnmax,Tn) obtained based on the maximum equivalent cumulative use time tnmax by the total degradation E(tn,Tn) of the pixel circuit 51, the correction coefficient Kcmp (≤1) based on the maximum equivalent cumulative use time tnmax is obtained. Since the total degradation E(tn,Tn) of each pixel circuit 51 reflects the cumulative value of the energy of the drive current, the total degradation E(tn,Tn) indicates the time degradation of the OLED 52 (the same applies to the equivalent cumulative use time tn). Therefore, by using, as the corrected gradation data Pcmp, a product of the correction coefficient Kcmp obtained as described above and the gradation data P, the gradation data P is corrected such that gradation of other pixel circuit 51 is lowered, taking as a reference the pixel circuit 51 in which time degradation has progressed most. Therefore, the drive current becomes smaller than the original drive current in other pixel circuit 51 by taking as a reference the pixel circuit 51 in which time degradation has progressed most. Accordingly, burn-in can be prevented by performing luminance compensation, while suppressing time degradation of the OLED 52. Since it is not necessary to read various parameters (the voltage applied to both ends of the OLED 52, the drive current, and the like) from the pixel circuit 51 for correcting the gradation data P in the data processing device 10, increase in the number of wires can be suppressed.

Further, according to the present embodiment, the degradation coefficient Y is further reflected in the equivalent cumulative use time tn. Since time degradation of the OLED 52 also changes by the temperature, accurate luminance compensation can be performed by using the equivalent cumulative use time tn that further reflects the degradation coefficient Y.

Further, according to the present embodiment, the degradation coefficient Y based on the normal temperature Tn is acquired. Therefore, by acquiring the surrounding temperature, the degradation coefficient Y can be determined based on the above equation (14). Accordingly, it is not necessary to hold in advance the correlation data and the like between the cumulative value of the energy of the drive current and the surrounding temperature. Therefore, the memory capacity required in the data processing device 10 can be made relatively small.

Further, according to the present embodiment, the maximum equivalent cumulative use time tnmax and the equivalent cumulative use time tn are respectively converted to the total degradation E(tnmax,Tn) and the total degradation E(tn,Tn), and the correction coefficient Kcmp (1) is acquired by the above equation (17). By determining the correction coefficient Kcmp based on the total degradation E(tnmax, Tn) and the total degradation E(tn,Tn) in this way, more accurate luminance compensation can be performed.

Further, according to the present embodiment, by providing the data processing device 10 and the controller 21 as separate parts, for example, by providing the data processing device 10 in the front stage of the conventional controller 21, it is not necessary to change the controller to have a special specification. Particularly, by realizing the data processing device 10 as a chip set, a physical size of a memory necessary for the data processing device 10 can be made smaller than that in the case where the function of the data processing device 10 is incorporated in the controller 21.

According to the present embodiment, although tnmax in the above equation (17) is set as the maximum equivalent cumulative use time, an approximately maximum value obtained statistically from the equivalent cumulative use time tn of the total pixels may be used as tnmax. For example, there is a method of arranging the equivalent cumulative use time tn of the total pixels in the order of magnitude, selecting, as a group, at least one or more equivalent cumulative use times tn from a maximum value side, and setting a maximum value in the group as tnmax. Accordingly, by preventing acquisition of irregular maximum equivalent cumulative use time tnmax, the above effects can be obtained while securing average luminance. The correction coefficient Kcmp obtained in this case can also be said to be based on the above maximum equivalent cumulative use time tnmax.

2.1. Second Embodiment

<2.1 Overall Configuration>

Figure 10:
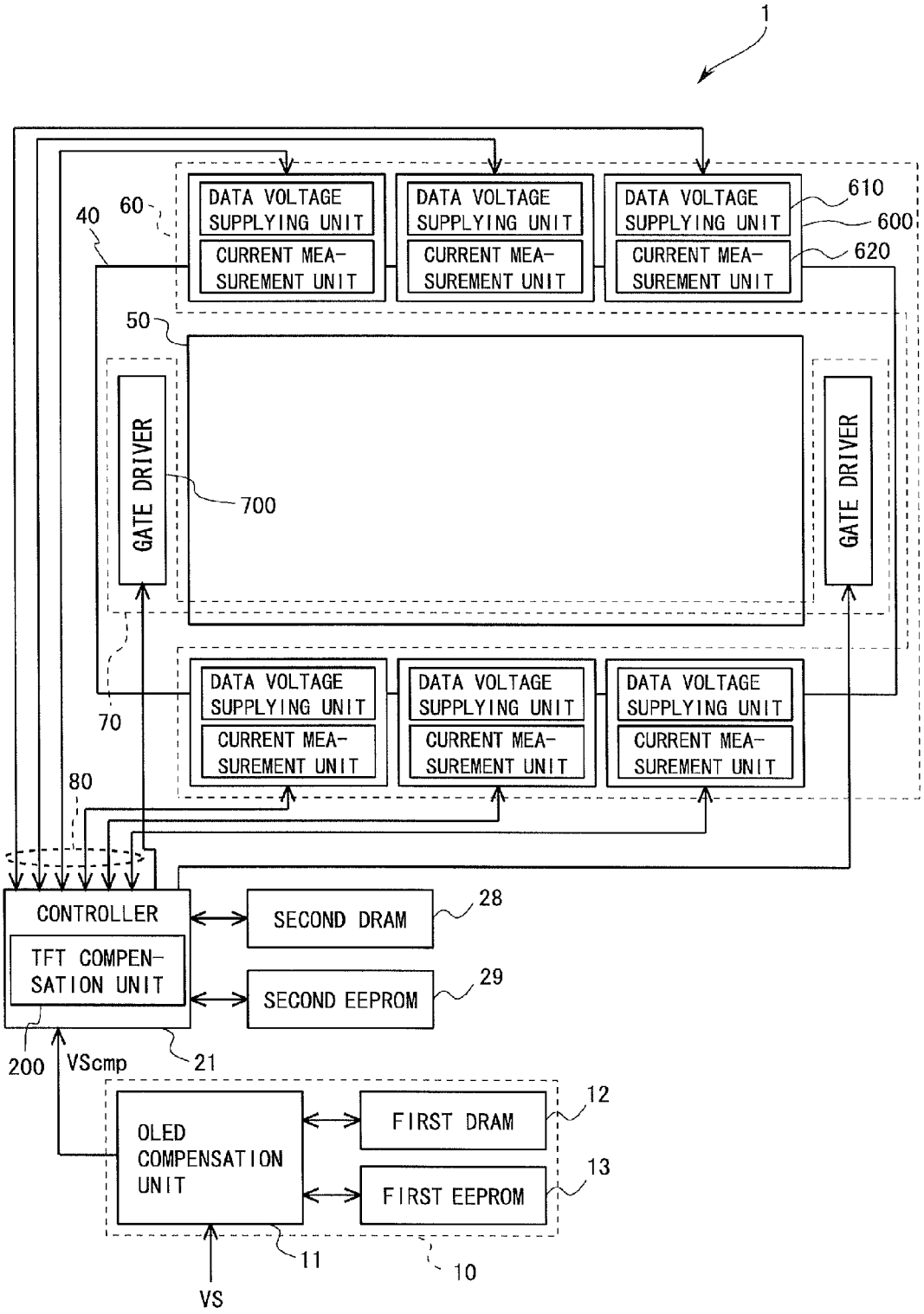
FIG. 10 is a block diagram showing a configuration of an organic EL display device according to a second embodiment of the present invention.

FIG. 10 is a block diagram showing a configuration of the active matrix-type organic EL display device 1 according to a second embodiment of the present invention. In the constituent elements of the present embodiment, for the elements same as those of the above first embodiment, the same reference characters are attached and the descriptions are omitted appropriately. The controller 21 in the present embodiment includes a TFT compensation unit 200. Each data driver 600 includes a data voltage supplying unit 610 and a current measurement unit 620. The data voltage supplying unit 610 has functions similar to those of the data driver 600 in the above first embodiment. The current measurement unit 620 measures a drive current obtained from the pixel circuit 51 in accordance with a data voltage based on drive gradation data, and acquires measurement data indicating a current value of the drive current. The current measurement unit 620 transmits the acquired measurement data to the controller 21. Transmission and reception of various data between the controller 21 and the data drive unit 60 are performed via a communication bus 80.

In the present embodiment, one frame period includes a video signal period and a vertical synchronization period. The video signal period in the present embodiment is also called a "scanning period". The vertical synchronization period in the present embodiment is also called a "vertical flyback period" or a "vertical blanking period". In the present embodiment, the video signal period corresponds to a first period, and the vertical synchronization period corresponds to a second period. The scanning drive unit 70 (the gate driver 700) alternately repeats the above video signal period for writing data voltages to the pixel circuits 51 by sequentially selecting n scanning lines DM, and the above vertical synchronization period for outputting, to data lines DA, drive currents from the pixel circuits 51 by sequentially selecting a predetermined number (p) of scanning lines DM out of the n scanning lines DM. Here, $1 \leq p < n$. It is preferable that that n is a natural number times of p. The organic EL display device 1 according to the present embodiment outputs the drive currents to the data lines DA and acquires the above measurement data, in the vertical synchronization period in which generally only various synchronization operations are performed. The scanning drive unit 70 shifts p scanning lines DM to be selected, in each vertical synchronization period (that is, in each one frame period).

<2.2 Pixel Circuit and Current Measurement>

FIG. 11 is a circuit diagram showing the pixel circuit 51 and a part of a constituent element at a data driver 600 side corresponding to the pixel circuit 51 according to the present embodiment. The pixel circuit 51 shown in FIG. 11 is a pixel circuit 51 in a j-th row and an i-th column. The pixel circuit 51 includes one OLED 52, three transistors T1 to T3, and one capacitor (a drive capacitive element) C1. The transistor T1 is a drive transistor, the transistor T2 is a reference voltage supply transistor, and the transistor T3 is an input transistor. The transistors T1 to T3 are all of n-channel type, and are InGaZnOx-TFTs, for example.

The transistor T1 is connected in series to the OLED 52, has as a first conductive terminal a drain terminal connected to the high-level power supply line ELVDD, and has as a second conductive terminal a source terminal connected to an anode terminal of the OLED 52. The transistor T2 has a gate terminal connected to the scanning line DMj, and is provided between a reference voltage line Vref and a gate terminal of the transistor T1. The transistor T3 has a gate terminal connected to the scanning line DMj, and is provided between the data line DAi and the source terminal of the transistor T1. The capacitor C1 is provided between the gate terminal and the source terminal of the transistor T1. A cathode terminal of the OLED 52 is connected to the low-level power supply line ELVSS.

The data driver 600 includes a DAC 630, an operational amplifier 640, a resistor element R1, a control switch SW, and a measurement data acquiring unit 650. The DAC 630 is a constituent element of the data voltage supplying unit 610. The operational amplifier 640 and the control switch SW are constituent elements shared by the data voltage supplying unit 610 and the current measurement unit 620. The resistor element R1 and the measurement data acquiring unit 650 are constituent elements of the current measurement unit 620. The resistor element R1 functions as a current-voltage conversion element.

The non-inverting input terminal of the operational amplifier 640 is connected to the output terminal of the DAC 630, and the inverting input terminal is connected to a corresponding data line DAi. Between the output terminal and the inverting input terminal of the operational amplifier 640, the resistor element R1 and the control switch SW are connected in parallel. The control switch SW is controlled by an input-output control signal DWT transmitted from the controller 21, for example, and is closed when DWT="1" and is opened when DWT="0". The measurement data acquiring unit 650 acquires measurement data output from the operational amplifier 640.

When the input-output control signal DWT is at the "1" level, since the control switch SW is closed, the output terminal and the inverting input terminal of the operational amplifier 640 are short-circuited. Therefore, when the input-output control signal DWT is at the "1" level, the operational amplifier 640 functions as a buffer amplifier. Accordingly, the data voltage Vm(i,j,P) is supplied to the data line DAi in the low-output impedance. At this time, it is desirable that the data voltage Vm(i,j,P) is not input to the measurement data acquiring unit 650, by controlling the measurement data acquiring unit 650 by the input-output control signal DWT. The gradation P mentioned here is actually the corrected gradation Pcmp in the above first embodiment corrected by the controller 21. However, for the sake of convenience, the corrected gradation Pcmp corrected by the controller 21 is described as the gradation P (the same applies to the drawing concerning the present embodiment).

When the input-output control signal DWT is at the "0" level, since the control switch SW is open, the output terminal and the inverting input terminal of the operational amplifier 640 are connected to each other via the resistor element R1. Therefore, the operational amplifier 640 functions as a current amplifying amplifier using the resistor element R1 as a feedback resistor. At this time, when the data voltage Vm(i,j,P) is input to the non-inverting input terminal of the operational amplifier 640, the potential of the inverting input terminal also becomes Vm(i,j,P) by the virtual short circuiting. Further, at this time, a drive current that flows in accordance with the gate-source voltage Vgs based on the data voltage Vm(i,j,P) (the drive current is hereinafter represented by symbol I(i,j,P)) is output from the pixel circuit 51 in the j-th row and the i-th column to the data line DAi (to be described in detail later). Accordingly, the output voltage of the operational amplifier 640 becomes "Vm(i,j,P)−R1*I(i,j,P)". Based on "Vm(i,j,P)−R1*I(i,j,P)", the measurement data acquiring unit 650 acquires measurement data corresponding to the data voltage Vm(i,j,P) (the measurement data may be represented by the same symbol Is(i,j,P) similarly to the drive current).

<2.3 Operation in Video Signal Period>

Figure 12:
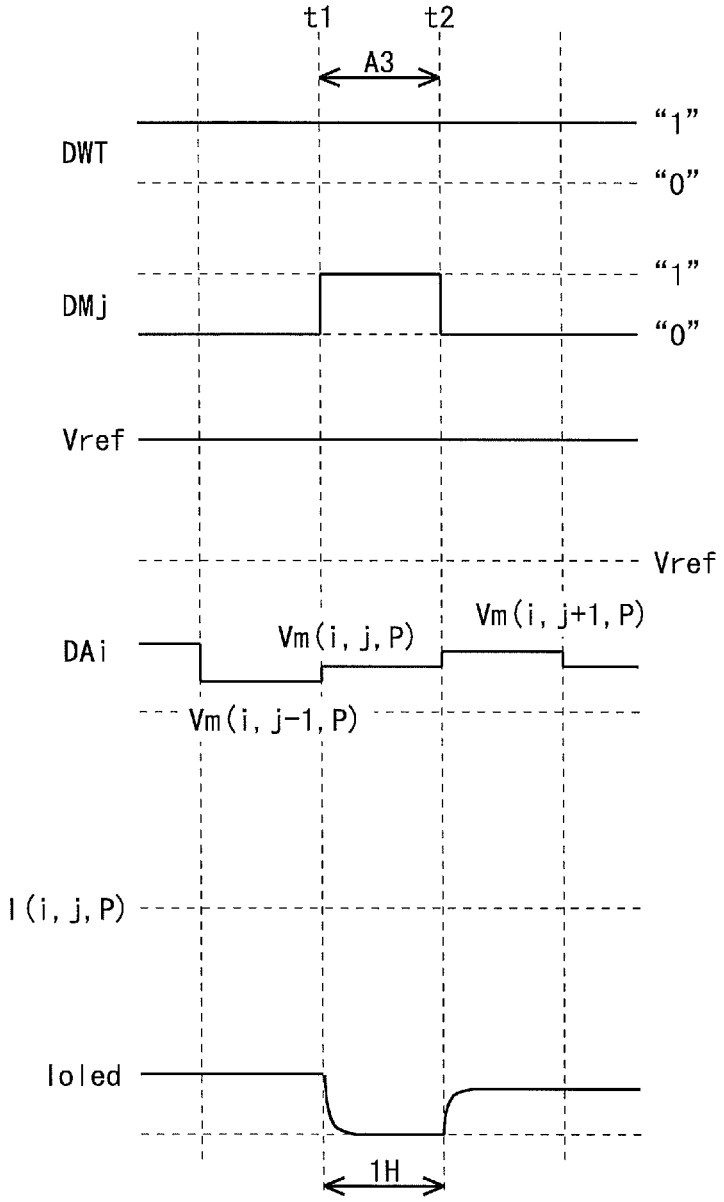
FIG. 12 is a timing chart for describing the operation in a video signal period of the pixel circuit and the part of the constituent element at the data driver side corresponding to the pixel circuit, both shown in FIG. 11.
Figure 13:
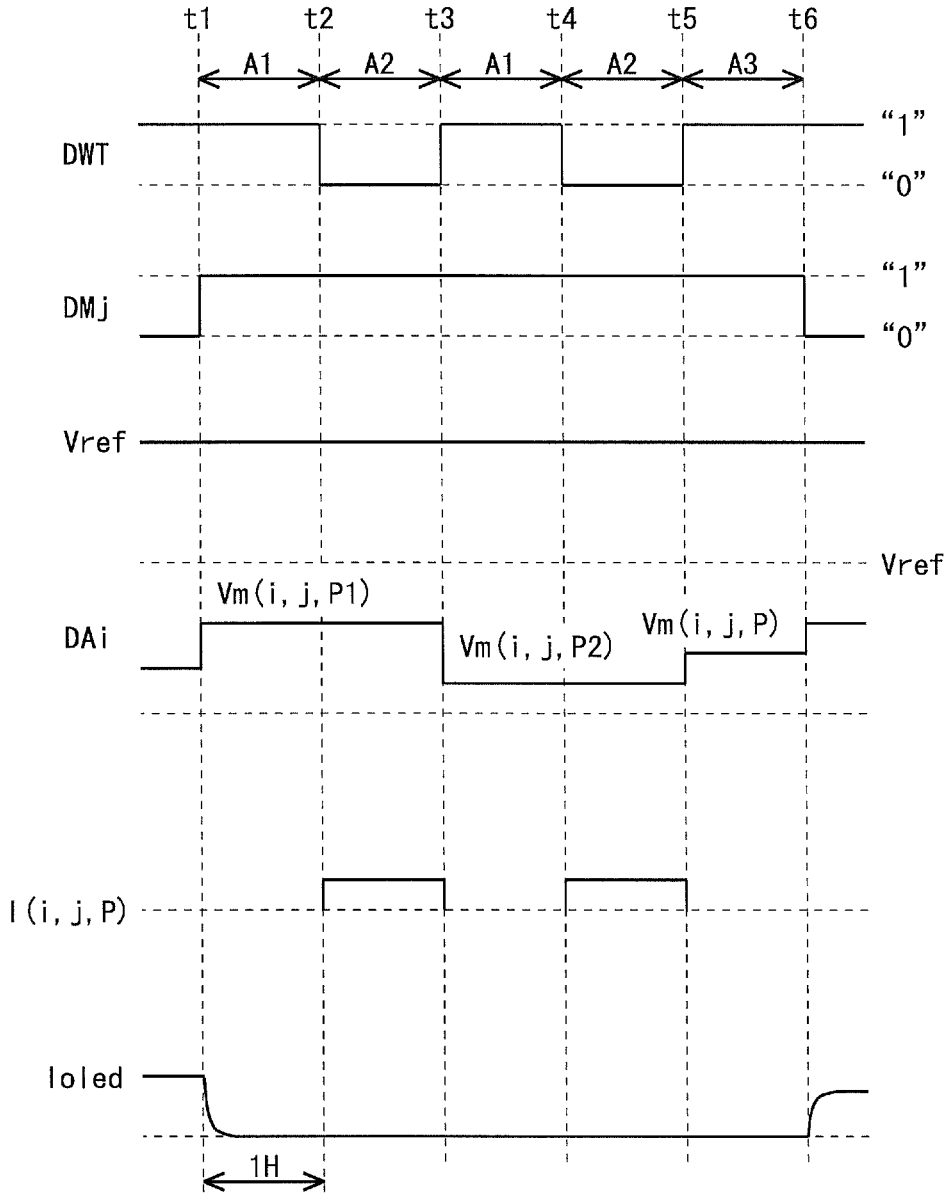
FIG. 13 is a timing chart for describing the operation in a vertical synchronization period of the pixel circuit and the part of the constituent element at the data driver side corresponding to the pixel circuit, both shown in FIG. 11.

FIG. 12 is a timing chart for describing the operation in the video signal period of the pixel circuit 51 and a part of the constituent element at the data driver 600 side corresponding to the pixel circuit 51, both shown in FIG. 11. In FIG. 12 and FIG. 13, "I(i,j,P)" represents measurement data. A period A3 from time t1 to t2 is a period for writing to the pixel circuit 51 the data voltage Vm corresponding to a desired gradation P (the period is hereinafter referred to as a "desired-gradation program period").

In the video signal period, as described above, n scanning lines DM are selected sequentially. Further, in the video signal period, the input-output control signal is at the "1" level. Therefore, the operational amplifier 640 functions as a buffer amplifier as described above.

Before time t1, the potential of the scanning line DMj is at the "0" level. At this time, the transistors T2 and T3 are in the off state, and a drive current I(i,j,P) according to the gate-source voltage Vgs held in the capacitor C1 flows through the transistor T1. The OLED 52 emits light in luminance according to the drive current I(i,j,P). In the following, in the case of distinguishing between the drive current that flows through the transistor T1 and the drive current that flows through the OLED 52, the drive current that flows through the OLED 52 is referred to as a light emission drive current Ioled. In one horizontal (1H) period immediately before a desired-gradation program period A3, the data line DAi supplies a data voltage Vm(i,j−1,P).

At time t1, a data voltage Vm(i,j,P) is supplied to the data line DAi via the operational amplifier 640. The potential of the scanning line DMj changes to the "1" level, and the transistors T2 and T3 are turned on. Therefore, the data voltage Vm(i,j,P) is given to one end of the capacitor C1 (the source terminal side of the transistor T1) via the data line DAi and the transistor T3. A reference voltage Vref is given to the other end of the capacitor C1 (the gate terminal side of the transistor T1) via the transistor T2. Accordingly, in the desired-gradation program period A3 from time t1 to t2, the capacitor C1 is charged to the gate-source voltage Vgs given by the following equation (19).

$$Vgs=Vref-Vm(i,j,P) \tag{19}$$

When a threshold voltage of the OLED 52 is Vtholed, it is desirable that the data voltage Vm(i,j,P) is set to a value given by the following equation (20).

$$Vm(i,j,P)<ELVSS+Vtholed \tag{20}$$

When the data voltage Vm(i,j,P) set as shown in the equation (20) is given to the anode terminal of the OLED 52 (the source terminal of the transistor T1), the light emission drive current Ioled becomes zero in the desired-gradation program period A3 (the same applies to periods A1 and A2 described later). Therefore, light emission of the OLED 52 can be stopped.

At time t2, the potential of the scanning line DMj changes to the "0" level, and the transistors T2 and T3 are turned off. Therefore, the holding voltage of the capacitor C1 is settled as the gate-source voltage Vgs shown in the above equation (19). At this time, since the source terminal of the transistor T1 is electrically disconnected from the data line DAi, the light emission drive current Ioled according to the gate-source voltage Vgs flows, and the OLED 52 emits light in luminance according to the light emission drive current Ioled. When the OLED 52 emits light in the luminance according to the light emission drive current Ioled in this way, Ioled=I(i,j,P). Since the transistor T1 operates in the saturation region, the light emission drive current Ioled is given by the following equation (21).

$$Ioled=(\beta/2)*(Vgs-Vt)^2=(\beta/2)*(Vref-Vm(i,j,P)-Vt)^2 \quad (21)$$

The data voltage Vm(i,j,P) in the equation (21) is set such that threshold voltage compensation and gain compensation of the transistor T1 are performed, which will be described in detail later. By performing the above operation sequentially in the desired-gradation program period A3 for each scanning line DM, the data voltage Vm is written to the total pixel circuits 51 in the video signal period. In the video signal period, the drive current I is not measured.

In the present embodiment, since the high-level power supply line ELVDD is not connected to the capacitor C1, the gate-source voltage Vgs becomes a value which does not depend on the high-level power supply voltage ELVDD. Therefore, as shown in the equation (21), the light emission drive current Ioled also becomes a value which does not depend on the high-level power supply voltage ELVDD. According to such a pixel circuit configuration, even when a large current flows through the high-level power supply line ELVDD in order to drive the OLED 52 and a drop voltage has occurred due to the wire resistance of the high-level power supply line ELVDD, the light emission drive current Ioled does not vary.

<2.4 Operation in Vertical Synchronization Period>

FIG. 13 is a timing chart for describing the operation in the vertical synchronization period of the pixel circuit 51 and a part of the constituent element at the data driver 600 side corresponding to the pixel circuit 51, both shown in FIG. 11. Each of a period A1 from time t1 to t2 and a period A1 from time t3 to t4 is a period for writing to the pixel circuit 51 the data voltage Vm corresponding to the gradation used for measurement of the drive current I (hereinafter, the gradation is referred to as a "measurement gradation", Vm may also be simply referred to as a "measurement data voltage", and each of the periods is referred to as a "measurement gradation program period"). There are two kinds of measurement gradation. One is a relatively low first gradation P1 out of gradations that can be set by the controller 21 based on the video signal VScmp, and the other is a relatively high second gradation P2 out of the gradations that can be set by the controller 21 based on the video signal VScmp. A concrete setting of the first and second gradations P1 and P2 will be described later. Each of a period A2 from time t2 to t3 and a period A2 from time t4 to t5 is a period for measuring the drive current I according to the measurement data voltage Vm (the period is hereinafter referred to as a "current measurement period"). In the following, the measurement data voltage corresponding to the first gradation P1 is referred to as a "first measurement data voltage", and the measurement data voltage corresponding to the second gradation P2 is referred to as a "second measurement data voltage". The gradation data (actually, the corrected gradation data, but described as the gradation data for the sake of convenience) indicating the first gradation P1 is referred to as "first measurement gradation data", and the gradation data indicating the second gradation P2 is referred to as "second measurement gradation data".

In the vertical synchronization period, p scanning lines DM are selected sequentially as described above. When it is assumed that the display panel 40 in the present embodiment is an FHD (Full High Definition) system, a total number of scanning lines is 1125, and a number of effective scanning lines is 1080. The number n of the above scanning line DM corresponds to the number of the effective scanning lines. In the FHD system, since one frame period corresponds to 1125H periods and the video signal period corresponds to 1080H periods, the vertical synchronization period corresponds to 45H periods. In the present embodiment, p=9. In the vertical synchronization period, nine scanning lines DM are selected sequentially, each for 5H periods. The value of p and the length of the period for selecting the scanning line DM shown here are mere examples, and the present invention is not limited thereto.

As shown in FIG. 13, in the 5H periods from time t1 to t6 in which the potential of the scanning line DMj is at the "1" level, the level of the input-output control signal DWT is switched for each 1H period in the order of the "1" level, the "0" level, the "1" level, the "0" level, and the "1" level. When the input-output control signal DWT is at the "1" level, the operational amplifier 640 functions as a buffer amplifier as described above. When the input-output control signal DWT is at the "0" level, the operational amplifier 640 functions as a current amplifying amplifier as described above.

Before time t1, the potential of the scanning line DMj is at the "0" level. At this time, the transistors T2 and T3 are in the off state, and the transistor T1 passes the drive current I(i,j,P) according to the gate-source voltage Vgs held in the capacitor C1. The drive current I(i,j,P) that flows through the transistor T1 flows through the OLED 52 as the light emission drive current Ioled. Then, the OLED 52 emits light in luminance according to the light emission drive current Ioled.

At time t1, the potential of the scanning line DMj changes to the "1" level, and the transistors T2 and T3 are turned on. Further, the input-output control signal DWT becomes the "1" level, and the control switch SW is closed. To the non-inverting input terminal of the operational amplifier 640, a first measurement data voltage Vm(i,j,P1) is input. Therefore, the first measurement data voltage Vm(i,j,P1) is supplied to the data line DAi. Accordingly, in a manner similar to that in the above desired-gradation program period A3, in the measurement gradation program period A1 from time t1 to t2, the capacitor C1 is charged to the gate-source voltage Vgs given by the following equation (22).

$$Vgs=Vref-Vm(i,j,P1) \quad (22)$$

In the following, the measurement gradation program period A1 in which the first measurement data voltage Vm(i,j,P1) is written is referred to as a "first measurement gradation program period".

At time t2, the input-output control signal DWT changes to the "0" level, and the control switch SW is opened. Since the first measurement data voltage Vm(i,j,P1) is input to the non-inverting input terminal of the operational amplifier 640 subsequently to time t1, the potential of the inverting input terminal also becomes the first measurement data voltage Vm(i,j,P1) by virtual short circuiting. Since the data line DAi has been already charged to the first measurement data voltage Vm(i,j,P1) in the period A1 from time t1 to t2, the time required for the potential of the inverting input terminal to become the first measurement data voltage Vm(i,j,P1) is short. In the current measurement period A2 from time t2 to t3, a current path of a drive current I(i,j,P1) via the transistor T3 in the on state is formed, and the drive current I(i,j,P1) is output from the pixel circuit 51 to the data line DAi. From the above equation (20), the light emission drive current Ioled does not flow. As described above, when the transistor T3 is in the on state, the transistor T3 can output the drive current I(i,j,P1) to the data line DAi (the same applies to a drive current I(i,j,P2) described later). Since a measurement procedure of the drive current I(i,j,P1) output to the data line DAi is as described above, the description will be omitted here. In the following, the drive current I(i,j,P1) corresponding to the first gradation P1 is referred to as a "first drive current", and the current measurement period A2 in which the first drive current I(i,j,P1) is measured is referred to as a "first current measurement period". The measurement data I(i,j,P1) indicating a value of the first drive current I(i,j,P1) is referred to as "first measurement data".

The operation in the measurement gradation program period A1 from time t3 to t4 is the same as the operation in the first measurement gradation program period A1 from time t1 to t2, except that the first gradation P1 is changed to the second gradation P2. Therefore, a detailed description of the operation will be omitted. In the following, the measurement gradation program period A1 in which the second measurement data voltage Vm(i,j,P2) is written is referred to as a "second measurement gradation program period".

The operation in the current measurement period A2 from time t4 to t5 is the same as the operation in the first current measurement period A2 from time t2 to t3, except that the first gradation P1 is changed to the second gradation P2. Therefore, a detailed description of the operation will be omitted. In the following, the drive current I(i,j,P2) corresponding to the second gradation P2 is referred to as a "second drive current", and the current measurement period A2 in which the second drive current I(i,j,P2) is measured is referred to as a "second current measurement period". The measurement data I(i,j,P2) indicating a value of the second drive current I(i,j,P2) is referred to as "second measurement data".

The operation in the desired-gradation program period A3 from time t5 to t6 is similar to that in the video signal period. Therefore, a detailed description of the operation will be omitted. However, the data voltage Vm(i,j,P) written to the pixel circuit 51 in the desired-gradation program period A3 in the vertical synchronization period in the present embodiment is the value in which there is reflected the correction data updated based on the first measurement data I(i,j,P1) and the second measurement data I(i,j,P2) acquired in the vertical synchronization period (to be described in detail later).

At time t6, the potential of the scanning line DMj changes to the "0" level, and the transistors T2 and T3 are turned off. Therefore, the holding voltage of the capacitor C1 is settled as the gate-source voltage Vgs shown in the above equation (19). At this time, since the source terminal of the transistor T1 is electrically disconnected from the data line DAi, the light emission drive current Ioled shown in the above equation (21) flows, and the OLED 52 emits light in luminance according to the light emission drive current Ioled.

Here, the second measurement gradation program period A1 and the second current measurement period A2 are provided after the first measurement gradation program period A1 and the first current measurement period A2. However, the first measurement gradation program period A1 and the first current measurement period A2 may be provided after the second measurement gradation program period A1 and the second current measurement period A2.

By performing, for each of the p scanning lines DM, the above-described operations in the first measurement gradation program period A1, the first current measurement period A2, the second measurement gradation program period A1, the second current measurement period A2, and the desired-gradation program period A3, measurement of the drive current I for each of the pixel circuits 51 corresponding to the p scanning lines DM (that is, (m×p) pixel circuits) is performed.

After measurement of the drive current I for each of the pixel circuits 51 corresponding to the first to p-th row scanning lines DM1 to DMp has been performed in the vertical synchronization period in a certain frame period, measurement of the drive current I for each of the pixel circuits 51 corresponding to the (p+1)-th to 2p-th row scanning lines DMp+1 to DM2*p* is performed in the vertical synchronization period of the next frame period. After measurement of the drive current I for each of the pixel circuits 51 corresponding to the (n-p+1)-th to n-th row scanning lines DMn-p+1 to DMn has been performed in the vertical synchronization period in a certain frame period, measurement of the drive current I for each of the pixel circuits 51 corresponding to the first to p-th row scanning lines DM1 to DMp is performed in the vertical synchronization period of the next frame period. In this manner, by sequentially shifting (m×p) pixel circuits 51 to be measured without ovrelapping in each one frame period, the drive current I can be measured for each of the (m×n) pixel circuits 51. When p=9 in the FHD system as described above, measurement of the drive current I can be performed for all the pixel circuits 51 in 120 frame periods (1080 rows/9 rows), that is, in two seconds.

<2.5 Data Communication Between Controller and Data Driver>

Figure 14:
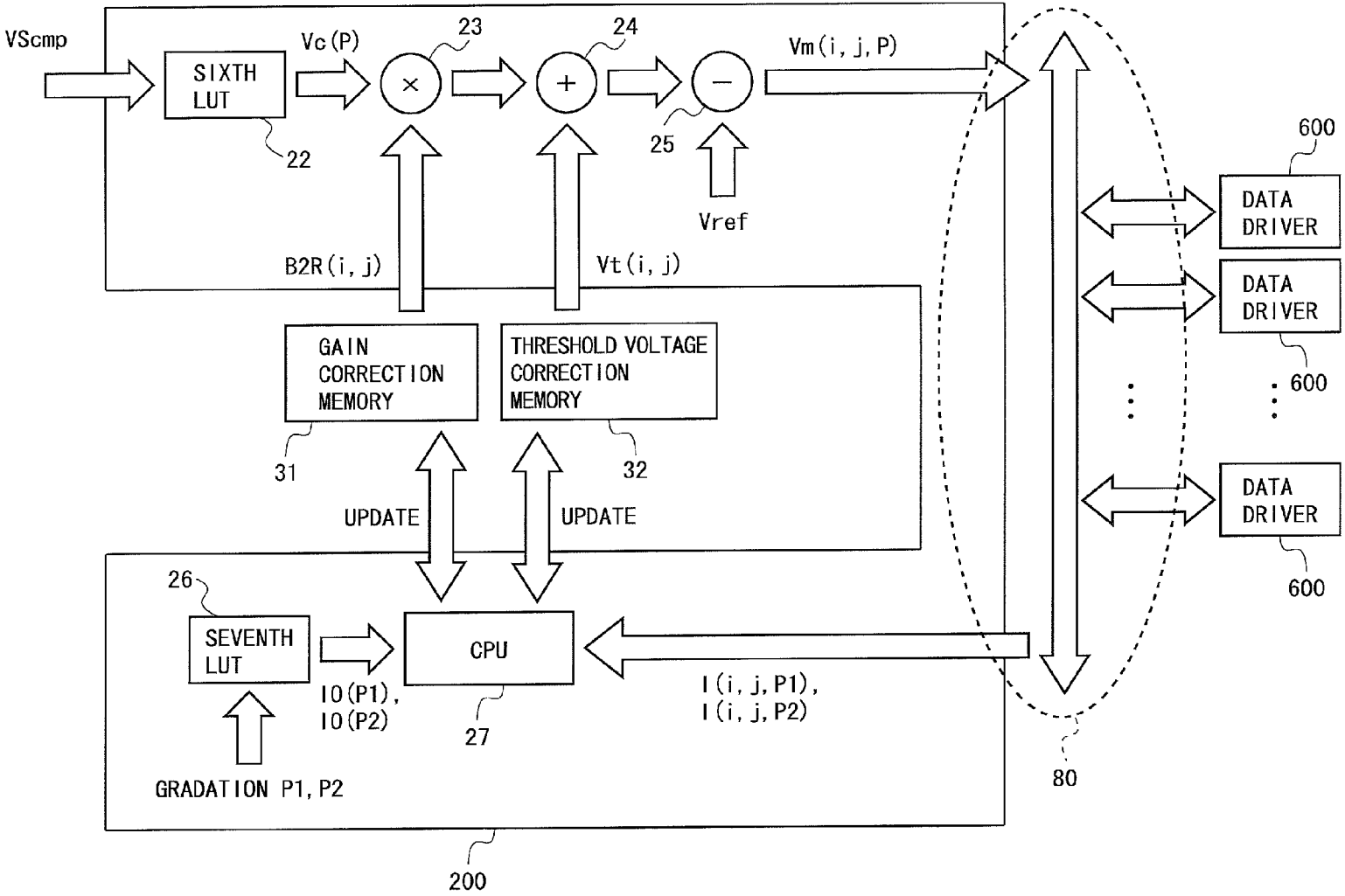
FIG. 14 is a block diagram for describing data communication between a controller and a data driver according to the above second embodiment.

FIG. 14 is a block diagram for describing data communication between the controller 21 and the data driver 600 according to the present embodiment. In the present embodiment, the communication bus 80 is configured by a bidirectional communication bus enabling bidirectional data communication between the controller 21 and the data driver 600. Kinds of the bidirectional communication bus are not particularly limited, and include, for example, a low voltage differential signaling (LVDS), a mobile industry processor interface (MIPI), and an embedded display port (e-DP).

A gain correction memory 31 and a threshold voltage correction memory 32 shown in FIG. 14 are realized by a predetermined storage region of the second DRAM 28. The gain correction memory 31 stores gain correction data for correcting the voltage data Vm(i,j,P) such that gain compensation of the transistor T1 (the drive transistor) is performed. The threshold voltage correction memory 32 stores threshold voltage correction data for correcting the voltage data Vm(i,j,P) such that threshold voltage compensation of the transistor T1 is performed. The gain correction data and the threshold voltage correction data are prepared for each pixel circuit 51. In the following, the gain correction data corresponding to the pixel circuit 51 in the j-th row and the i-th column is represented by symbol B2R(i,j). The threshold voltage correction data corresponding to the pixel circuit 51 in the j-th row and the i-th column is represented by symbol Vt(i,j). In the present embodiment, gain correction data B2R(i,j) corresponds to the second correction data, and threshold voltage correction data Vt(i,j) corresponds to the first correction data. It is assumed that the initial value of the gain correction data B2R(i,j) is set to one, and that the initial value of the threshold voltage correction data Vt(i,j) is set to a predetermined value common to each pixel circuit 51. In the present embodiment, the storage unit is realized by the second DRAM 28.

The TFT compensation unit 200 of the controller 21 includes a sixth LUT 22, a third multiplying unit 23, a second adding unit 24, a subtracting unit 25, a seventh LUT 26, and a central processing unit (CPU) 27. In place of the CPU 27, a logic circuit and the like may be used. The CPU 27 controls various operations of the controller 21.

The sixth LUT 22 receives a corrected video signal VScmp (the corrected gradation data Pcmp) from the data processing device 10, and converts the gradation P (actually, the corrected gradation Pcmp, as described above) to a control voltage Vc(P) for each pixel circuit 51, and outputs a converted result. Details of the conversion by the sixth LUT 22 will be described later.

The third multiplying unit 23 receives the control voltage Vc(P) from the sixth LUT 22, and receives the gain correction data B2R(i,j) read from the gain correction memory 31. A read timing of the gain correction data B2R(i,j) from the gain correction memory 31 is controlled by the CPU 27 and the like. The third multiplying unit 23 outputs "Vc(P)*B2R(i,j)" obtained by multiplying the gain correction data B2R(i,j) by the control voltage Vc(P).

The second adding unit 24 receives the output of the third multiplying unit 23, and receives the threshold voltage correction data Vt(i,j) read from the threshold voltage correction memory 32. A read timing of the threshold voltage correction data Vt(i,j) from the threshold voltage correction memory 32 is controlled by the CPU 27 and the like. The second adding unit 24 outputs "Vc(P)*B2R(i,j)+Vt(i,j)" obtained by adding the threshold voltage correction data Vt(i,j) to the output of the third multiplying unit 23.

The subtracting unit 25 receives the output of the second adding unit 24 and the reference voltage Vref, and outputs as the voltage data Vm(i,j,P) a value obtained by subtracting the output of the second adding unit 24 from the reference voltage Vref. The voltage data Vm(i,j,P) output from the subtracting unit 25 is held in the buffer memory (not shown), for example, and is transmitted to the corresponding data driver 600 via the bidirectional communication bus 80 at a predetermined timing based on the control by the CPU 27. The voltage data Vm(i,j,P) output by the subtracting unit 25 is given by the following equation (23).

$$Vm(i,j,P)=Vref-Vc(P)*B2R(i,j)-Vt(i,j) \quad (23)$$

In the present embodiment, the voltage data Vm(i,j,P) given by the equation (23) corresponds to the drive gradation data.

By substituting the equation (23) in the above equation (21), the following equation (24) is obtained.

$$Ioled=(\beta/2)*(Vc(P)*B2R(i,j)+Vt(i,j)-Vt)^2 \quad (24)$$

From the equation (24), it can be understood that gain compensation and threshold voltage compensation are possible, by setting the gain correction data B2R(i,j) and the threshold voltage correction data Vt(i,j) to values according to the state of the transistor T1. Further, since the gradation P shown here is the corrected gradation Pcmp as described above, compensation similar to that in the above first embodiment is also performed.

The above-described conversion by the sixth LUT 22 will be further described. It is assumed here that the current for turning on the OLED 52 in maximum luminance Yw is Iw, and the gate-source voltage Vgs of the transistor T1 at this time is given by the following equation (25).

$$Vgs=Vw+Vth \quad (25)$$

In this case, the conversion by the sixth LUT 22 may be performed according to the following equation (26), for example.

$$Vc(P)=Vw*p^{1.1} \quad (26)$$

By selecting the control voltage Vc(P) in this way, light emission drive current Ioled(P) corresponding to the gradation P is given by the following equation (27). It is assumed that B2R(i,j)=1 and Vt(i,j)=Vt.

$$Ioled(P)=(\beta/2)*Vw^2*p^{2.2} \quad (27)$$

Therefore, the light emission drive current Ioled has characteristic of γ=2.2 to the gradation P, and emission luminance proportional to the light emission drive current Ioled can be also set to γ=2.2.

The equation (27) shows an ideal case where the output current of the transistor T1 (the drive current) has a square-law characteristic to the input control voltage. However, in the region where the output current is small, the output current does not have the square-law characteristic actually. Therefore, it is desirable that the conversion by the sixth LUT 22 outputs Vc(P) which is normalized by the following equation (28) in place of the equation (26). Accordingly, conversion accuracy by the sixth LUT 22 can be improved.

$$Vc(P)=Vw*Vn(P) \quad (28)$$

Here, Vn(P) is a value nonlinear to the gradation P.

The seventh LUT 26 receives the first and second gradations P1 and P2, converts the first and second gradations P1 and P2 to ideal characteristic data IO(P) that indicates an ideal display characteristic (more specifically, a value of ideal gradation versus drive current) corresponding to each of the first and second gradations P1 and P2, and outputs the ideal characteristic data IO(P). Here, the ideal characteristic data IO(P) is given by the following equation (29).

$$IO(P)=Iw*p^{2.2} \quad (29)$$

The CPU 27 receives first measurement data I(i,j,P1) and second measurement data I(i,j,P2), at a predetermined timing from the data driver 600 via the bidirectional communication bus 80. When the CPU 27 receives the first measurement data I(i,j,P1), the CPU 27 receives the ideal characteristic data IO(P1) corresponding to the first gradation P1, from the seventh LUT 26. Then, the CPU 27 compares the ideal characteristic data IO(P1) with the first measurement data I(i,j,P1), and updates the threshold voltage correction data Vt(i,j) based on the comparison result.

Specifically, the CPU 27 updates the threshold voltage correction data Vt(i,j) as follows. When the first measurement data I(i,j,P1) satisfies the following equation (30), the CPU 27 sets the threshold voltage correction data Vt(i,j) to "Vt(i,j)+ΔV". When the first measurement data I(i,j,P1) satisfies the following equation (31), the CPU 27 sets the threshold voltage correction data Vt(i,j) to "Vt(i,j)−ΔV". When the first measurement data I(i,j,P1) satisfies the following equation (32), the CPU 27 keeps the threshold voltage correction data Vt(i,j) as it is in "Vt(i,j)". Here, ΔV indicates a predetermined fixed value for changing the value of the threshold voltage correction data Vt(i,j). More specifically, ΔV indicates a minimum value capable of changing the value of the threshold voltage correction data Vt(i,j). That is, the threshold voltage correction data Vt(i,j) is updated by a minimum width.

$$IO(P1)-I(i,j,P1)>0 \quad (30)$$

$$IO(P1)-I(i,j,P1)<0 \quad (31)$$

$$IO(P1)-I(i,j,P1)=0 \quad (32)$$

When the CPU 27 receives the second measurement data I(i,j,P2), the CPU 27 receives ideal characteristic data IO(P2) corresponding to the second gradation P2, from the seventh LUT 26. Then, the CPU 27 compares the ideal characteristic data IO(P2) with the second measurement data I(i,j,P2), and updates the gain correction data B2R(i,j) based on the comparison result.

Specifically, the CPU 27 updates the gain correction data B2R(i,j) as follows. When the second measurement data I(i,j,P2) satisfies the following equation (33), the CPU 27 sets the gain correction data B2R(i,j) to "B2R(i,j)+ΔB". When the second measurement data I(i,j,P2) satisfies the following equation (34), the CPU 27 sets the gain correction data B2R(i,j) to "B2R(i,j)−ΔB". When the second measurement data I(i,j,P2) satisfies the following equation (35), the CPU 27 keeps the gain correction data B2R(i,j) as it is in "B2R(i,j)". Here, ΔB indicates a predetermined fixed value for changing the value of the gain correction data B2R(i,j). More specifically, ΔB indicates a minimum value capable of changing the value of the gain correction data B2R(i,j). That is, the gain correction data B2R(i,j) is updated by a minimum width.

$$IO(P2)-I(i,j,P2)>0 \tag{33}$$

$$IO(P2)-I(i,j,P2)<0 \tag{34}$$

$$IO(P2)-I(i,j,P2)=0 \tag{35}$$

As described above, for each pixel circuit 51, the threshold voltage correction data Vt(i,j) and the gain correction data B2R(i,j) are updated at each time of receiving the first measurement data I(i,j,P1) and the second measurement data I(i,j,P2), respectively, and the voltage data Vm(i,j,P) based on the threshold voltage correction data Vt(i,j) and the gain correction data B2R(i,j) is generated. In other words, the voltage data Vm(i,j,P) is corrected based on the first measurement data I(i,j,P1) and the second measurement data I(i,j,P2), or based on the threshold voltage correction data Vt(i,j) and the gain correction data B2R(i,j).

A reason that the first measurement data I(i,j,P1) is used as a criteria for updating the threshold voltage correction data Vt(i,j) is as follows. When the transistor T1 is driven in accordance with the first measurement data voltage Vm(i,j,P1), the gate-source voltage Vgs of the transistor T1 is relatively small. Therefore, a gap of the threshold voltage Vt from the gate-source voltage Vgs is reflected largely in the first drive current I(i,j,P1). Accordingly, the first measurement data I(i,j,P1) is suitable for the criteria for updating the threshold voltage correction data Vt(i,j).

On the other hand, a reason that the second measurement data I(i,j,P2) is used for a criteria for updating the gain correction data B2R(i,j) is as follows. When the transistor T1 is driven in accordance with the second measurement data voltage Vm(i,j,P2), the gate-source voltage Vgs of the transistor T1 is relatively large. Therefore, while the gap of the threshold voltage Vt from the gate-source voltage Vgs is not reflected easily in the second drive current I(i,j,P2), the gap of the gain β is reflected relatively largely in the second drive current I(i,j,P2). Accordingly, the second measurement data I(i,j,P2) is suitable for the criteria for updating the gain correction data B2R(i,j).

<2.6 Effects>

According to the present embodiment, in the vertical synchronization period, p scanning lines are selected sequentially, and the drive current I is measured for each data line DA, so that the first measurement data I(i,j,P1) and the second measurement data I(i,j,P2) are acquired for each pixel circuit 51. Based on the first measurement data I(i,j,P1) and the second measurement data I(i,j,P2), the voltage data Vm(i,j,P) is corrected. When the transistor T1 is driven in accordance with the first measurement data voltage Vm(i,j,P1), since the gate-source voltage Vgs of the transistor T1 is relatively small, a gap of the threshold voltage Vt from the gate-source voltage Vgs is reflected largely in the first drive current I(i,j,P1). On the other hand, when the transistor T1 is driven in accordance with the second measurement data voltage Vm(i,j,P2), since the gate-source voltage Vgs of the transistor T1 is relatively large, a gap of the threshold voltage Vt from the gate-source voltage Vgs is not reflected easily in the second drive current Im(i,j,P2), but a gap of the gain β is reflected relatively largely in the second drive current Im(i,j,P2). Therefore, the first measurement data I(i,j,P1) is the data in which the gap of the threshold voltage Vt is reflected largely, and the second measurement data I(i,j,P2) is the data in which the gap of the gain β is reflected largely. As described above, the voltage data Vm(i,j,P) is corrected based on both the first measurement data I(i,j,P1) in which the gap of the threshold voltage Vt is reflected largely and the second measurement data I(i,j,P2) in which the gap of the gain β is reflected largely, so that both threshold voltage compensation and gain compensation of the transistor T1 can be performed for each pixel circuit 51. Further, in the vertical synchronization period, since it is not necessary to stop light emission of the OLED 52 in parts other than the pixel circuit 51 which is a target for measuring the drive current I, compensation can be performed while performing the display. Further, since the voltage data Vm(i,j,P) is corrected based on the first measurement data I(i,j,P1) and the second measurement data I(i,j,P2) which are acquired in the vertical synchronization period, compensation following the chronological change of the characteristic of the transistor T1 can be performed. Further, since the drive current in which threshold voltage compensation and gain compensation of the transistor T1 are performed as described above (the drive current close to the desired value following γ=2.2) flows through each pixel circuit 51, errors in the correction of the gradation data P can be reduced reliably in the data processing device 10. Further, since the data line DA is used to read the drive current I from the pixel circuit 51, increase in the number of wires can be suppressed.

Further, according to the present embodiment, the second DRAM 28 storing the threshold voltage correction data Vt(i,j) and the gain correction data B2R(i,j) is provided. Based on a result of comparing the ideal characteristic data IO(P) with the first measurement data Im(i,j,P1) and the second measurement data Im(i,j,P2), the threshold voltage correction data Vt(i,j) and the gain correction data B2R(i,j) are updated respectively. By performing such update, compensation following the chronological change of the characteristic of the transistor T1 can be performed reliably. Since the second DRAM 28 is provided at the outside of the data drive unit 60, the configuration of the data drive unit 60 can be simplified. Further, by using the ideal characteristic data IO(P), the threshold voltage correction data Vt(i,j) and the gain correction data B2R(i,j) can be updated by a simple processing.

According to the present embodiment, since the bidirectional communication bus is used, it is not necessary to separately provide wires for transmitting data from the data driver 600 to the controller 21. Therefore, increase in the number of wires can be suppressed.

3. Third Embodiment

<3.1 Overall Configuration>

Figure 15:
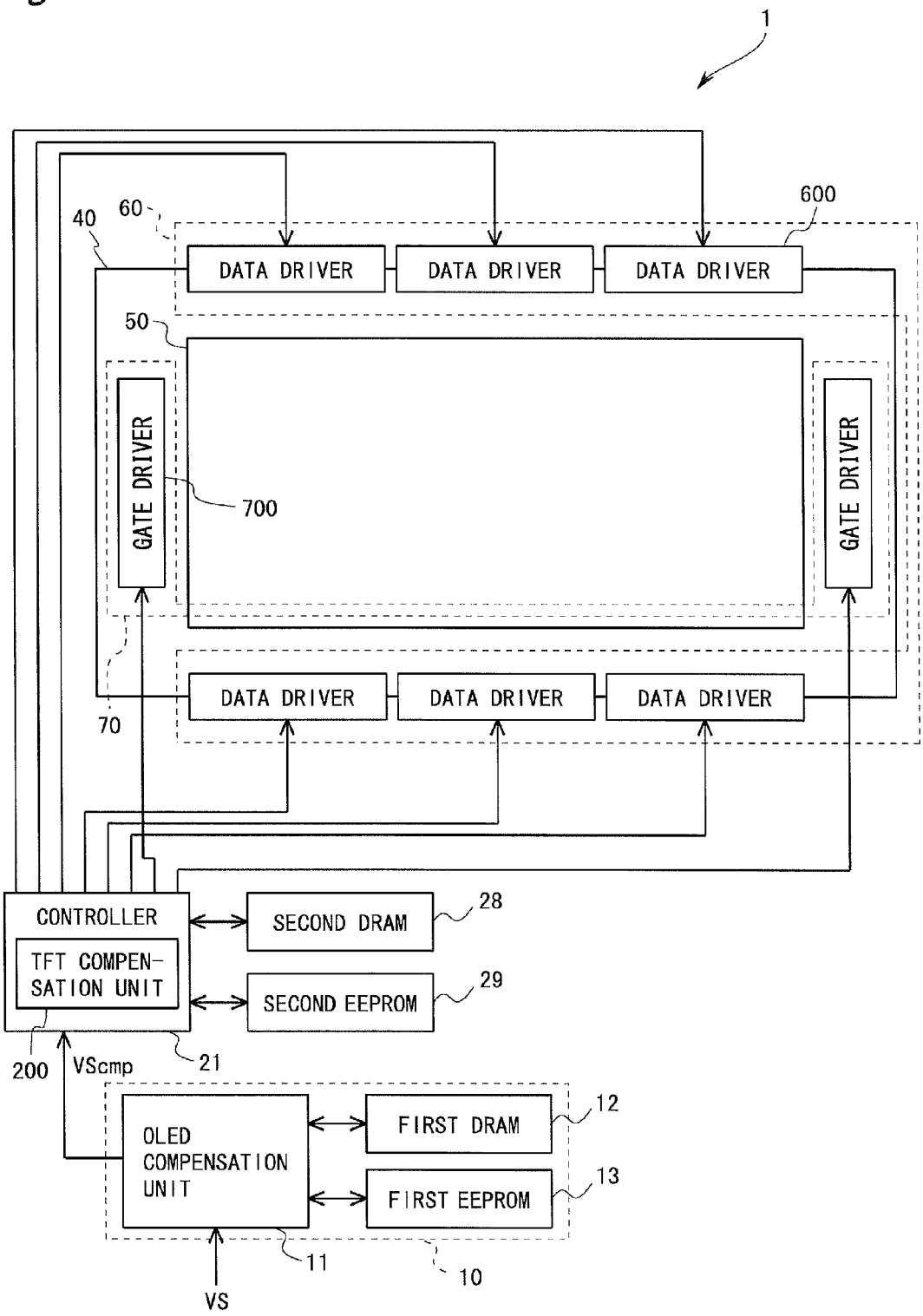
FIG. 15 is a block diagram showing a configuration of an organic EL display device according to a third embodiment of the present invention.
Figure 16:
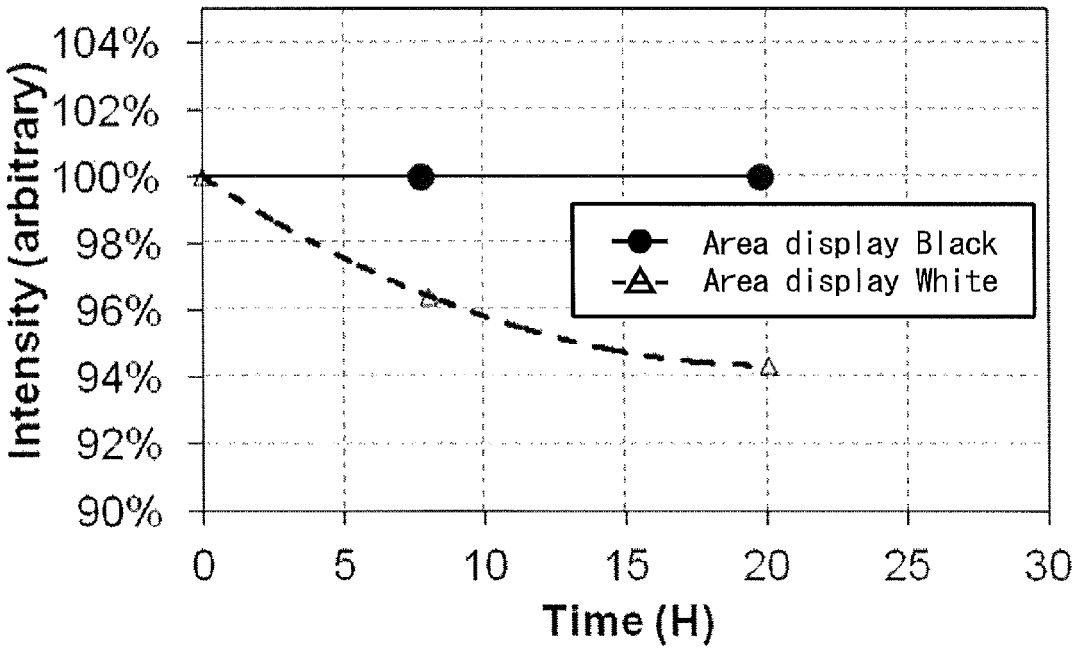
FIG. 16 is a diagram for describing an influence that time degradation of the OLED exterts on a display.

FIG. 15 is a block diagram showing a configuration of the active matrix-type organic EL display device 1 according to a third embodiment of the present invention. In the constituent elements of the present embodiment, for the elements same as those of the above first embodiment, the same reference characters are attached and the descriptions are omitted appropriately. In the present embodiment, the TFT compensation unit 200 is provided in the controller 21 in the above first embodiment. The configuration of the pixel circuit 51 may be similar to that in the above first embodiment or similar to that in the above second embodiment.

The TFT compensation unit 200 in the present embodiment performs various compensations without using the measurement data I, unlike that in the above second embodiment. As contents and techniques of compensation by the TFT compensation unit 200, all known contents and techniques can be employed, including the following, for example. The TFT compensation unit 200 acquires correction data for at least one of threshold voltage compensation and gain compensation of the transistor T1 according to a current which is assumed to flow through the OLED 52, based on the corrected video signal VScmp (the corrected gradation data Pcmp). The TFT compensation unit 200 corrects the corrected gradation data Pcmp based on the correction data, and acquires the drive gradation data accordingly. For acquiring the correction data, the second DRAM 28 can be used if necessary.

<3.2 Effects>

According to the present embodiment, without measuring the drive current I, the controller 21 (the TFT compensation unit 200) corrects the corrected gradation data Pcmp for at least one of threshold voltage compensation and gain compensation of the transistor T1. Therefore, effects similar to those in the above second embodiment can be obtained with a simple configuration. However, in the above second embodiment in which the drive current I is measured actually, accuracy in threshold voltage compensation and gain compensation of the transistor T1 is higher. As a result, accuracy in the correction of the gradation data P in the data processing device 10 is also higher.

<4. Others>

The present invention is not limited to the above-described embodiments, and can be implemented by various modifications in a range not deviating from the gist of the present invention. For example, in the above first embodiment, the degradation coefficient Y may not be necessarily used. In this case, the temperature sensor 101, the first LUT 102, the second LUT 103, the first multiplying unit 105, the fourth LUT 109, and the fifth LUT 110 are not used. Further, the integration unit 106 acquires the equivalent cumulative current Iequ(i,j) as an equivalent cumulative value. To the integration unit 106, $X^{4.4}$ is directly given from the third LUT 104. Then, in the dividing unit 111, a value obtained by dividing the equivalent cumulative current Iequ(i,j) in each pixel by a maximum equivalent cumulative current Iequ(i,j) among equivalent cumulative currents Iequ(i,j) of total pixels is acquired as a correction coefficient Kcmp. In this way, except that accuracy in luminance compensation becomes low by not considering the surrounding temperature, effects similar to those in the above first embodiment can be obtained. In this case, the equivalent cumulative current Iequ(i,j) shown in the above equation (5) corresponds to the equivalent cumulative value, and the equivalent current shown in the above equation (4) corresponds to the unit equivalent value.

The correction coefficient Kcmp used in the present invention is not limited to that obtained as described in the above first embodiment. The correction coefficient Kcmp obtained for each pixel circuit 51 is only required to be approximately equal to or smaller than one by taking as a reference the maximum equivalent cumulative use time tnmax (may also be the above maximum equivalent cumulative current Iequ(i,j)), based on the pixel circuit 51.

In the above first embodiment, data of the equivalent cumulative use time to held in the memory 107*b* may be compressed by a known data compression method. Examples of the known data compression method include compression using a discrete cosine transformation, compression using a wavelet conversion, and run-length compression (refer to Patent Documents 4 to 6).

In the above first and third embodiments, threshold voltage compensation may be performed, for example, by providing a transistor for threshold voltage compensation in the pixel circuit 51.

In the second embodiment, the pixel circuit 51 is configured to output the drive current I to the data line DA, but it is not limited to the above-described configuration example. Even in such a case, by measuring the drive current I, various corrections can be performed based on the measurement result. Therefore, since each pixel circuit 51 can apply the drive current I close to a desired value, errors in the correction of the gradation data P can be reduced in the data processing device 10.

In the second embodiment, in place of the bidirectional communication bus, unidirectional communication buses may be used. In this case, the number of wires between the controller 21 and the data driver 600 increases more than that in the first embodiment. However, since the data line DA is used for reading the drive current I from the pixel circuit 51 as described above, increase in the number of wires necessary to read the drive current I from the pixel circuit 51 can be suppressed.

INDUSTRIAL APPLICABILITY

Since the data processing device for a display device and the data processing method according to the present invention are capable of preventing burn-in while suppressing time degradation of the electro-optical element and increase in the number of wires, the data processing device and the data processing method can be used for various display devices, such as the organic EL display device, using the electro-optical element as a display element.

DESCRIPTION OF REFERENCE CHARACTERS

1: ORGANIC EL DISPLAY DEVICE
10: DATA PROCESSING DEVICE
12: FIRST DRAM
21: CONTROLLER (DISPLAY CONTROL UNIT)
28: SECOND DRAM (STORAGE UNIT)
40: DISPLAY PANEL
50: DISPLAY UNIT
51: PIXEL CIRCUIT
52: OLED (ELECTRO-OPTICAL ELEMENT)
60: DATA DRIVE UNIT
70: SCANNING DRIVE UNIT
80: COMMUNICATION BUS
101: TEMPERATURE SENSOR (TEMPERATURE ACQUIRING UNIT)
102: FIRST LUT
103: SECOND LUT
104: THIRD LUT
105: FIRST MULTIPLYING UNIT
106: INTEGRATION UNIT
107*a*: FIRST ADDING UNIT

107*b*: MEMORY
108: MAXIMUM VALUE DETECTING UNIT
109: FOURTH LUT
110: FIFTH LUT
112: SECOND MULTIPLYING UNIT (CORRECTING UNIT)
121: EQUIVALENT CUMULATIVE VALUE ACQUIRING UNIT
122: CORRECTION COEFFICIENT ACQUIRING UNIT
123: UNIT EQUIVALENT VALUE ACQUIRING UNIT
124: DEGRADATION COEFFICIENT ACQUIRING UNIT
125: CONVERSION UNIT
600: DATA DRIVER
610: DATA VOLTAGE SUPPLYING UNIT
620: CURRENT MEASUREMENT UNIT
T1 to T3: TRANSISTOR
C1: CAPACITOR (DRIVE CAPACITIVE ELEMENT)
P: GRADATION DATA
Pcmp: CORRECTED GRADATION DATA
VS: VIDEO SIGNAL
VScmp: CORRECTED VIDEO SIGNAL
DA: DATA LINE
DM: SCANNING LINE

The invention claimed is:

1. An active matrix-type display device comprising:

a plurality of data lines;

a plurality of scanning lines;

a plurality of pixel circuits arranged corresponding to the plurality of data lines and the plurality of scanning lines, each of the pixel circuits having an electro-optical element whose luminance is controlled by a current;

a data drive unit that drives the plurality of data lines;

a scanning drive unit that drives the plurality of scanning lines;

a data processing device including;

an equivalent cumulative value acquiring unit that acquires, for each pixel circuit, an equivalent cumulative value reflecting a cumulative value of energy of a current which flows through at least the electro-optical element, based on gradation data corresponding to the luminance of the electro-optical element, a correction coefficient acquiring unit that acquires, for each pixel circuit based on the equivalent cumulative value of the pixel circuit, a correction coefficient which is equal to or smaller than one when taking, as a reference, a maximum equivalent cumulative value among the equivalent cumulative values of the plurality of pixel circuits, and a correcting unit that outputs, as corrected gradation data, a value obtained by multiplying the correction coefficient by the gradation data;

a display control unit that controls the data drive unit and the scanning drive unit, and receives the corrected gradation data from the data processing device and transmits, to the data drive unit, drive gradation data obtained based on the corrected gradation data; and a storage unit that stores correction data used for re-correcting the corrected gradation data, wherein the pixel circuit further includes;

an input transistor having a control terminal connected to the scanning line, and which is in an on state when the scanning line is selected and is capable of outputting, to the data line, the current flowing through the drive transistor, when the input transistor is in the on state, a drive capacitive element to which a data voltage based on the drive gradation data is given via the data line and the input transistor, and a drive transistor that controls current to be supplied to the electro-optical element, in accordance with a voltage held by the drive capacitive element, the scanning drive unit alternately repeats a first period for writing the data voltage to the pixel circuit by sequentially selecting the plurality of scanning lines and a second period for outputting the current flowing through the drive transistor, from the pixel circuit to the data line via the input transistor, by sequentially selecting a predetermined number of scanning lines out of the plurality of scanning lines, and shifts, in each of the second period, the predetermined number of scanning lines to be selected, the data drive unit includes;

a current measurement unit that, in the second period, acquires for each of the data lines, first measurement data by measuring a current flowing through the electro-optical element in accordance with a data voltage based on drive gradation data corresponding to a relatively low first gradation out of a plurality of gradations, and acquires second measurement data by measuring a current flowing through the electro-optical element in accordance with a data voltage based on drive gradation data corresponding to a relatively high second gradation out of the plurality of gradations, and a data voltage supplying unit that supplies the data voltage to the data line in the first period and the second period, the display control unit acquires the drive gradation data, by re-correcting the corrected gradation data based on the first measurement data and the second measurement data acquired by the current measurement unit, the current measurement unit transmits the first measurement data and the second measurement data to the display control unit in the second period, in the second period, the display control unit transmits, to the data drive unit, drive gradation data indicating respectively the first gradation and the second gradation, receives the first measurement data and the second measurement data from the current measurement unit, and updates the correction data based on a result of comparing ideal characteristic data indicating an ideal characteristic of the drive transistor corresponding respectively to the first gradation and the second gradation, with the received first measurement data and the received second measurement data, and in the first period and the second period, the display control unit reads the correction data from the storage unit, and re-corrects the corrected gradation data based on the correction data.

2. The display device according to claim 1, wherein the correction data includes first correction data for threshold voltage compensation of the drive transistor, and second correction data for gain compensation of the drive transistor, and the display control unit updates the first correction data based on a result of comparing the first measurement data with the ideal characteristic data, and updates the second correction data based on a result of comparing the second measurement data with the ideal characteristic data.

3. The display device according to claim 1, wherein the display control unit and the data drive unit perform transmission and reception of the drive gradation data, the first measurement data, and the second measurement data by using a bidirectional communication bus.

4. An active matrix-type display device compromising:

a plurality of data lines;

a plurality of scanning lines;

a plurality of pixel circuits arranged corresponding to the plurality of data lines and the plurality of scanning lines, each of the pixel circuits having an electro-optical element whose luminance is controlled by a current;

a data drive unit that drives the plurality of data lines;

a scanning drive unit that drives the plurality of scanning lines;

a data processing device including;

an equivalent cumulative value acquiring unit that acquires, for each pixel circuit, an equivalent cumulative value reflecting a cumulative value of energy of a current which flows through at least the electro-optical element, based on gradation data corresponding to the luminance of the electro-optical element, a correction coefficient acquiring unit that acquires, for each pixel circuit based on the equivalent cumulative value of the pixel circuit, a correction coefficient which is equal to or smaller than one when taking, as a reference, a maximum equivalent cumulative value among the equivalent cumulative values of the plurality of pixel circuits, and a correcting unit that outputs, as corrected gradation data, a value obtained by multiplying the correction coefficient by the gradation data; and a display control unit that controls the data drive unit and the scanning drive unit, and receives the corrected gradation data from the data processing device and transmits, to the data drive unit, drive gradation data obtained based on the corrected gradation data, wherein the pixel circuit further includes;

an input transistor having a control terminal connected to the scanning line, and which is in an on state when the scanning line is selected and is capable of outputting, to the data line, the current flowing through the drive transistor, when the input transistor is in the on state;

a drive capacitive element to which a data voltage based on the drive gradation data is given via the data line and the input transistor, and a drive transistor that controls current to be supplied to the electro-optical element, in accordance with a voltage held by the drive capacitive element, the scanning drive unit alternately repeats a first period for writing the data voltage to the pixel circuit by sequentially selecting the plurality of scanning lines and a second period for outputting the current flowing through the drive transistor, from the pixel circuit to the data line via the input transistor, by sequentially selecting a predetermined number of scanning lines out of the plurality of scanning lines, and shifts, in each of the second period, the predetermined number of scanning lines to be selected, the data drive unit includes;

a current measurement unit that, in the second period, acquires for each of the data lines, first measurement data by measuring a current flowing through the electro-optical element in accordance with a data voltage based on drive gradation data corresponding to a relatively low first gradation out of a plurality of gradations, and acquires second measurement data by measuring a current flowing through the electro-optical element in accordance with a data voltage based on drive gradation data corresponding to a relatively high second gradation out of the plurality of gradations, and a data voltage supplying unit that supplies the data voltage to the data line in the first period and the second period, the display control unit acquires the drive gradation data, by re-correcting the corrected gradation data based on the first measurement data and the second measurement data acquired by the current measurement unit, the current measurement unit and the data voltage supplying unit include an operational amplifier and a control switch in a shared manner, the current measurement unit further includes a D/A converter, the data voltage supplying unit further includes a resistor element and a measurement data acquiring unit, a non-inverting input terminal of the operational amplifier is connected to an output terminal of the D/A converter, an inverting input terminal of the operational amplifier is connected to the data line, the resistor element and the control switch are provided in parallel between an output terminal and the inverting input terminal of the operational amplifier, the measurement data acquiring unit acquires measurement data based on an output of the operational amplifier, when an input-output control signal is in a first level, the control switch is closed, the output terminal and the inverting input terminal of the operational amplifier are short-circuited, and the data voltage is supplied to the data line in a low-output impedance, and when the input-output control signal is in a second level, the control switch is open, the output terminal and the inverting input terminal of the operational amplifier are connected via the resistor element, the non-inverting input terminal and the inverting input terminal of the operational amplifier have a same potential, an output voltage of the operational amplifier equals to a voltage obtained by subtracting, from the data voltage, a product of a resistance of the resistor element and a drive current based on the data voltage, and the measurement data acquiring unit acquires measurement data corresponding to the data voltage, based on the output voltage of the operational amplifier.

5. The display device according to claim 4, wherein when the input-output control signal is controlled to the first level, a first measurement voltage is supplied to the data line, when the input-output control signal is next controlled to the second level, a first measurement data corresponding to the first measurement voltage is obtained, when the input-output control signal is next controlled to the first level, a second measurement voltage is supplied to the data line, and when the input-output control signal is next controlled to the second level, a second measurement data corresponding to the second measurement voltage is obtained.

6. The display device according to claim 4, wherein the display control unit and the data drive unit perform transmission and reception of the drive gradation data, the first measurement data, and the second measurement data by using a bidirectional communication bus.

7. The display device according to claim 4, wherein the measurement data acquiring unit is configured so that the data voltage is not input, by controlling the input-output control signal.

* * * * *